US010011119B2

(12) United States Patent
Michallon et al.

(10) Patent No.: US 10,011,119 B2
(45) Date of Patent: Jul. 3, 2018

(54) METHOD AND DEVICE FOR ADDING SOLVENT IN SMALL QUANTITIES

(71) Applicant: Dover Europe Sàrl, Vernier (CH)

(72) Inventors: Jannick Michallon, Saint Peray (FR); Jean-François Desse, Guiherand Granges (FR)

(73) Assignee: DOVER EUROPE SÁRL, Vernier (CH)

( * ) Notice: Subject to any disclaimer, the term of this patent is extended or adjusted under 35 U.S.C. 154(b) by 0 days.

(21) Appl. No.: 15/442,112

(22) Filed: Feb. 24, 2017

(65) Prior Publication Data

US 2017/0246876 A1 Aug. 31, 2017

(30) Foreign Application Priority Data

Feb. 26, 2016 (FR) ..... 16 51624

(51) Int. Cl.
*B41J 2/195* (2006.01)
*B41J 2/175* (2006.01)

(52) U.S. Cl.
CPC ..... *B41J 2/17566* (2013.01); *B41J 2/195* (2013.01)

(58) Field of Classification Search
CPC ..... B41J 2/195; B41J 2/175
See application file for complete search history.

(56) References Cited

U.S. PATENT DOCUMENTS 4,555,712 A 11/1985 Arway et al.
4,905,503 A * 3/1990 Langrick ..... B41J 2/195 73/54.06
5,160,939 A 11/1992 Bajeux et al.
5,451,987 A 9/1995 Perrin
5,455,606 A * 10/1995 Keeling ..... B41J 2/115 347/7
5,459,497 A * 10/1995 Manning ..... B41J 2/175 347/6

(Continued)

FOREIGN PATENT DOCUMENTS

EP 0 228 828 A2 7/1987
EP 2 165 832 A2 3/2010

(Continued)

OTHER PUBLICATIONS

French Search Report issued in Patent Application No. FR 1651624 dated Nov. 16, 2016.

(Continued)

*Primary Examiner* — Huan Tran
(74) *Attorney, Agent, or Firm* — Pearne & Gordon LLP

(57) ABSTRACT

The invention relates to a method for controlling the ink quality of an ink jet printer, during printing, the printer comprising at least one ink reservoir (11) and a solvent or diluted ink reservoir (12), a print head (50) and a supply circuit for sending ink and/or solvent to the print head, method in which: a correction volume of solvent, or diluted ink, to add to the ink to compensate a variation in viscosity of the latter is estimated; and a plurality of elementary quantities of solvent, or diluted ink, separated by ink, is sent to the print head, each of a volume comprised between 0.1 $cm^3$ and 5 $cm^3$, the sum of the elementary quantities of solvent, or diluted ink, being substantially equal to the correction volume to add.

20 Claims, 12 Drawing Sheets

(56) References Cited

U.S. PATENT DOCUMENTS

| | | | | |
|---|---|---|---|---|
| 5,532,720 | A * | 7/1996 | Krueger | B41J 2/175 347/7 |
| 2001/0050017 | A1* | 12/2001 | Ohsawa | B41J 2/06 101/465 |
| 2001/0055047 | A1* | 12/2001 | Ohsawa | B41C 1/1066 347/55 |
| 2002/0001497 | A1* | 1/2002 | Naniwa | B41J 2/06 400/118.2 |
| 2002/0008746 | A1* | 1/2002 | Naniwa | B41J 2/06 347/89 |
| 2002/0180803 | A1* | 12/2002 | Kaplan | G01C 21/367 715/809 |
| 2010/0165020 | A1 | 7/2010 | Tojo et al. | |
| 2012/0327145 | A1 | 12/2012 | Pouzet | |
| 2016/0075897 | A1 | 3/2016 | Barbet et al. | |
| 2016/0291264 | A1 | 10/2016 | Audouard et al. | |

FOREIGN PATENT DOCUMENTS

| | | | | | |
|---|---|---|---|---|---|
| EP | 2 574 473 | A1 | | 4/2013 | |
| JP | 57-205158 | | * | 12/1982 | B41J 3/04 |
| JP | 61-121943 | | * | 6/1986 | B41J 3/04 |
| JP | 61-121945 | | * | 6/1986 | B41J 3/04 |
| WO | 2009-049135 | A1 | | 4/2009 | |
| WO | 2011-012641 | A1 | | 2/2011 | |
| WO | 2011-076810 | A1 | | 6/2011 | |
| WO | 2012-066356 | A1 | | 5/2012 | |
| WO | 2014-154830 | A1 | | 10/2014 | |

OTHER PUBLICATIONS

Specification and Drawings of U.S. Appl. No. 15/342,487 entitled "Device for Level Measurement in a Reservoir", filed Nov. 3, 2016.

* cited by examiner

METHOD AND DEVICE FOR ADDING SOLVENT IN SMALL QUANTITIES

TECHNICAL FIELD AND PRIOR ART

The invention relates to the field of continuous ink jet (CIJ) printers.

It also relates to the architecture (the layout of the ink circuit) of entry-level CIJ printers in order to minimise the cost thereof.

It also relates to a means for extending the functional domain of a membrane pump as a function of temperature.

Continuous ink jet (CIJ) printers are well known in the field of industrial coding and marking of various products, for example for marking bar codes or the use-by-date on foodstuffs directly on the production line and at high throughput. This type of printer is also found in certain decorative fields where the graphic printing possibilities of the technology are exploited.

These printers have several typical sub-assemblies as shown in FIG. 1.

Firstly, a print head 1, generally off-centre with respect to the body of the printer 3, is connected thereto by a flexible umbilical 2 grouping together the hydraulic and electrical links required for the operation of the head giving it a flexibility which facilitates integration on the production line.

The body of the printer 3 (also called console or cabinet) normally contains three sub-assemblies:

- an ink circuit 4 in the lower part of the console (zone 4'), which makes it possible, on the one hand, to supply ink to the head at a stable pressure and of a suitable quality and, on the other hand, to take charge of ink of jets not used for printing,
- a controller 5 situated in the upper part of the console (zone 5'), capable of managing the sequencing of actions and carrying out treatments enabling the activation of the different functions of the ink circuit and the head,
- an interface 6 which gives the operator the means of implementing the printer and being informed of its operation.

In other words, the cabinet comprises 2 sub-assemblies: in the upper part, the electronics, electrical supply and operator interface, and in the lower part an ink circuit supplying the ink, of nominal quality, under pressure to the head and under negative pressure for recovering ink not used by the head.

FIG. 2 schematically represents a print head 1 of a CIJ printer. It comprises a drop generator 60 supplied with electrically conducting ink pressurised by the ink circuit 4.

This generator is capable of emitting at least one continuous jet through an orifice of small dimension called nozzle. The jet is transformed into a regular succession of drops of identical size under the action of a periodic stimulation system (not represented) situated upstream of the outlet of the nozzle. When the drops 7 are not intended for printing, they head towards a gutter 62 which recovers them in order to recycle the unused ink through the ink circuit 4. Devices 61 placed along the jet (charge and deflection electrodes) make it possible, on command, to electrically charge the drops and to deflect them in an electric field Ed. These are then deviated from their natural ejection trajectory from the drop generator. The drops 9 intended for printing escape the gutter and are deposited on the support to be printed 8.

This description may apply to continuous ink jet (CIJ) printers designated binary or multi-deflection continuous jet printers. Binary CIJ printers are equipped with a head of which the drop generator has a multitude of jets, each drop of a jet may only be oriented towards 2 trajectories: printing or recovery. In multi-deflection continuous jet printers, each drop of a single jet (or several jets spaced apart) may be deflected onto various trajectories corresponding to different charge commands from one drop to the next, thus realising a scanning of the zone to print along a direction which is the direction of deflection, the other direction of scanning of the zone to be printed is covered by the relative movement of the print head and the support to be printed 8. Generally the elements are laid out such that these 2 directions are substantially perpendicular.

An ink circuit of a continuous ink jet printer firstly makes it possible to supply ink under regulated pressure, and potentially solvent, to the drop generator of the head 1 and to create a negative pressure for recovering the fluids not used for printing returning from the head.

It also enables the management of consumables (distribution of ink and solvent from a reserve) and the control and the maintaining of the quality of the ink (viscosity/concentration).

Finally, other functions are linked to user comfort and the automatic taking charge of certain maintenance operations in order to guarantee identical operation whatever the conditions of use. These functions include rinsing the head (drop generator, nozzle, gutter) with solvent, aid to preventive maintenance such as the replacement of components with limited lifetime (filters, pumps).

These different functions have very different aims and technical requirements. They are activated and sequenced by the controller 5 of the printer which is all the more complex the greater the number and sophistication of said functions.

Certain current printers are designed in a modular manner in order to facilitate in the extreme the maintenance of the machine which operates by rapid exchange, and without special tools, of certain modules. These may constitute more or less complex functional sub-assemblies of which one or more elements are components with limited lifetime (e.g. wear components) or components of which the performances degrade with time of use (e.g. clogging of filters). This solution, in general, adds additional costs to the strict realisation of the function fulfilled by the module because it is necessary to provide an autonomous structure for the module, electrical connectors, hydraulic connecting members, potentially self-sealing, to avoid the flow of fluids during the replacement of the module, and various other components which would not be necessary if the notion of module was not present.

An example of modular device is given in FIG. 1 of the document WO 2012066356. The hydraulic circuit that is represented therein implements exchangeable modules (references 50, 60 in this FIG. 1). This circuit is very complex, uses a high number of component; in particular, it uses numerous self-sealing connectors (73) making it possible to isolate the modules (50 and 60) from the body of the ink circuit at the moment of disconnection and thus avoid flows of fluids.

In other words, the presence of complex modules which are exchangeable as a unit generates high technical complexity and thus incompatible additional costs.

At present, facilitating maintenance leads to an increase in the costs of the machine. The relative positioning of the components retaining the fluids and interconnected together leads to constraints linked to the gravitational flow of the fluids.

More generally, in order to provide the user with ever greater user comfort and increasingly specialised performances making it possible to address applications which are increasingly difficult to satisfy, current printers are seeing their complexity increase in terms of sophistication and quantity of components.

Another example is given in the application WO 2009049135.

According to another aspect of known machines, the forced circulation of fluids and the control of their flow (closing/opening of conduits, shunting) are functions which are costly to realise, in particular for questions of operating reliability. They implement, in general, pumps as well as electromagnetic valves or valves, notably to assure the pressurisation of ink and potentially solvent to the head, the creation of a negative pressure for the recovery and the purge coming from the head, or the transfer of ink or solvent from one spot to another in the ink circuit.

According to yet another aspect of known machines, the vast majority of them use gear pump technology for the pressurisation of the ink and, in certain cases, for the creation of the negative recovery pressure. These high performance and high capacity pumps are very suitable from the technical point of view. In particular, they can deal with difficult inks and they have a long lifetime. But, they are very expensive.

Generally speaking, the ink circuit of known machines remains a costly element, on account of the numerous hydraulic components to implement.

The problem is thus posed of realising all or part of the functions of an ink circuit, in a CIJ type printer, at lower cost and with a reduced number of components, while guaranteeing a minimum reliability. It is thus sought to implement the fewest possible components, notably for functions such as the management of consumables and/or controlling and maintaining the quality of the ink and/or rinsing the head with solvent.

In particular, a problem is to reduce the number of hydraulic components and to simplify the interconnection of these components. Despite this, the satisfaction of the user must be assured which means that the effort on this reduction of the number of components does not affect the performances or the reliability.

Another problem, linked to the complexity of currently known machines, is the need for highly qualified operators. For example, the maintenance sequencings may be very complex.

There is thus a need for a printer suited to handling by operators with little training.

According to another aspect, the ink circuit comprises a considerable number of hydraulic, hydro-electric components, sensors etc. In fact, modern printers have numerous increasingly sophisticated and precise functions. The hydraulic components (pumps, electromagnetic valves, self-sealing connections, filters, various sensors) are present or are dimensioned to satisfy a level of quality, reliability, performance and service to the user. And maintenance functions are heavy consumers of components because they are often automated.

In such a printer, regulation of the viscosity of the ink may be carried out by addition of solvent to the ink. But the additions of solvent in general take place in a mixing reservoir from which an ink-solvent mixture is then sent to the print head. Such a system is complex. The problem is thus posed of finding a novel method and a novel device for carrying out an injection of solvent into a flow of ink, with a view to sending it to a print head.

Preferably, such a novel method and device would make it possible to minimise the number of components of an ink jet printer and/or would make it possible to use components less expensive than those currently used, while guaranteeing a good level of performance and reliability.

DESCRIPTION OF THE INVENTION

The invention firstly relates to a printing method using an ink jet printer, or a method for supplying with ink and with solvent the print head of an ink jet printer, or a method for controlling the quality, in particular the viscosity, of the ink of an ink jet printer, said printer comprising at least one ink reservoir (or first reservoir) and a solvent reservoir (or second reservoir), these 2 reservoirs being different to each other, a print head and a supply circuit for sending the ink and/or the solvent to the print head, method in which:

- a quantity, or correction volume, of solvent, to add to the ink to compensate a variation in viscosity, for example compared to a target (or nominal or reference) viscosity, is estimated,
- a plurality of elementary quantities of (pure) solvent, or diluted ink (coming from the $2^{nd}$ reservoir), separated by ink (coming from the $1^{st}$ reservoir), is sent to the print head, each elementary quantity having a volume for example comprised between 0.1 $cm^3$ and 5 $cm^3$, or between 0.1 $cm^3$ and 1 $cm^3$, the sum of the elementary quantities of solvent being substantially equal to the correction volume to add.

The successive micro-additions make it possible to restore the nominal (or reference) viscosity of the ink in the print head.

Sending elementary quantities of solvent, or diluted ink, separated by ink, makes it possible to benefit from a mixing effect, in the supply circuit, with the ink, to perturb as little as possible the jet produced by the print head. The added solvent, or diluted ink, has not been mixed beforehand with the ink, in the $1^{st}$ reservoir.

Each elementary quantity may, or not, be sent simultaneously with ink, but two successive elementary quantities of solvent or diluted ink are separated by ink or by non-diluted ink. In the case where 2 elementary quantities are sent without simultaneous sending of ink, one could talk about alternate sendings with ink.

An elementary quantity of solvent (or diluted ink) may be defined more precisely as a function of the configuration of the supply circuit, and thus of the volume of ink into which each elementary quantity is injected, but also with a view to limiting perturbations of the jet produced by the print head. In fact, a too considerable quantity of solvent (or diluted ink) injected into the flow of ink leads to a variation in speed of the jet, and thus of the position and of the quality of the breaking up of said jet, and/or of charge parameters of drops in the head.

A flow of recovered ink coming from a gutter of the print head is sent to the first reservoir (or ink reservoir).

The 2 reservoirs are different to each other. Each addition of solvent (or diluted ink) takes place downstream of the ink reservoir, which collects, preferably uniquely (it does not collect pure solvent or solvent via a dedicated circuit), ink returning from the print head. Each elementary quantity of solvent (or diluted ink) is thus injected into the supply circuit or into the print head, downstream of the reservoirs. But since each quantity injected is small, the print head is not perturbed by too considerable additions, which could lead, notably, to a variation in the speed of the jet.

The additions of elementary quantities of solvent (or diluted ink) may be a significant number, for example comprised between 10 and 500, or even between 10 and 5000.

The viscosity variation to compensate may result from a pressure measurement or pressure variation.

Each elementary quantity of solvent (or diluted ink) and/or the number and/or the frequency of sendings of elementary quantity of solvent (or diluted ink) may be calculated and/or be a function of the dilution coefficient and/or the volume of ink in which ink—solvent (or ink—diluted ink) mixing takes place before passing into the print head or therein. The elementary quantities of solvent (or diluted ink) of a plurality of elementary quantities may be identical.

In a variant, the quantity of solvent of one or more micro-additions may be different to that of one or more other micro-additions. According to one embodiment, the elementary quantity of the $1^{st}$ micro-addition is greater than the elementary quantity of each of the successive micro-additions; in a variant, successive elementary quantities decrease or reduce, the $n^{th}$ having a greater volume than the $(n-1)^{th}$, and do so up to the final (the $p^{th}$) (for n=1, . . . , p).

In a further variant, the reduction of successive elementary quantities may take place in plateaux: the n1 (n1>1) first elementary quantities each have a volume having an identical $1^{st}$ value, the following n2 (n2≥1) elementary quantities each have a volume having an identical $2^{nd}$ value smaller than the $1^{st}$ value; potentially n3 (n3≥1) following elementary quantities each have a volume having an identical $3^{rd}$ value smaller than the $2^{nd}$ value. It is thus possible to have $n_p$ groups of successive elementary quantities, the volume of each elementary quantity of each group $n_k$ (1<k<p) being identical but greater than that of the preceding group $n_{k-1}$. It is thus possible to compensate for example an insufficient resolution to vary the values of the quantities.

A greater volume of micro-addition at the start of the micro-additions is going to lead to a relatively important correction, the corrections brought about by the following micro-additions could be less.

This adjustment of the values of successive micro-additions makes it possible to restore more rapidly the target or nominal viscosity.

2 successive sendings of solvent (or diluted ink) are preferably separated by a duration enabling or favouring mixing, in the circuit, of the solvent (or diluted ink) and the ink sent. Elementary quantities too close together in time risk not mixing correctly with the ink, or causing a too considerable variation in the viscosity of the ink arriving at the head, and perturbing the jet of ink produced by the head, as explained above.

For example, the duration of separation of the injection of 2 elementary quantities of solvent is comprised between 0.1 s and 1 minute.

Each elementary quantity may be sent from the solvent (or diluted ink) reservoir, provided with an outlet valve, open for a duration for example comprised between 0.1 s and 5s. This duration may notably depend on the flow rate of solvent (or diluted ink) at the outlet of the second reservoir and the flow rate of ink.

The duration of opening of the valve depends on the flow rate of solvent (or diluted ink).

Each elementary quantity of solvent may be pumped from the solvent (or diluted ink) reservoir, using a pump, preferably a membrane pump, which also pumps ink from the ink reservoir.

Thus, a single pump is used to pump solvent (or diluted ink) and/or ink and to send it to the print head. A flow of ink and/or solvent (or diluted ink) may be sent, at the outlet of said common pump (preferably single), to means for damping pressure fluctuations of ink and/or solvent (or diluted ink).

According to one embodiment, to ensure optimal circulation of ink and/or solvent (or diluted ink), downstream of the pump the following are selected:

- a first passage for supplying the print head, for sending, thereto, ink and/or solvent (or diluted ink),
- or a second supply passage, parallel to the first supply passage, for supplying the print head with solvent (or with diluted ink).

According to an advantageous embodiment, the speed of the pump is adjusted as a function of a given pressure value. This makes it possible to take account of delays, in the line for supplying the print head, of various elements, for example a device for damping pressure variations.

The elementary quantities can be sent in the supply circuit upstream of the print head.

According to another particular embodiment, and preferably when the elementary quantities sent are elementary quantities of diluted ink, the elementary quantities are sent directly into the print head and mixing between this diluted ink and the ink takes place in the print head, but not in the supply circuit upstream of this head.

A method according to the invention may implement a device according to the invention, as described below.

The invention also relates to a printing device implementing a method as described above.

The invention also relates to a printing device, or an ink jet printer, or a device or circuit for supplying with ink and with solvent the print head of an ink jet printer, comprising:

- at least one ink reservoir (or first reservoir) and a (pure) solvent or diluted ink reservoir (or second reservoir),
- a print head,
- a supply circuit for sending ink and/or solvent (or diluted ink) to the print head,
- means for collecting in the first reservoir a flow of recovered ink coming from a gutter of the print head,
- means for estimating a quantity of solvent (or diluted ink), or correction volume, to add to the ink of the circuit to compensate a variation in viscosity, for example compared to a target viscosity,
- and means for sending to the print head a plurality of elementary quantities of solvent, or diluted ink (coming from the $2^{nd}$ reservoir), separated by ink, each elementary quantity having a volume for example comprised between 0.1 $cm^3$ and 5 $cm^3$, the sum of the elementary quantities of solvent being substantially equal to the correction volume to add.

The remarks made above, concerning the effects of the mixing of elementary quantities with ink, and the parameters making it possible to specify these elementary quantities and/or their number and/or their frequency of sending into the ink circuit, also apply here.

The 2 reservoirs are different to each other. The advantages of such a device are those already described above, in relation with the method.

Such a device may further comprise a pressure sensor for measuring a pressure of ink and/or solvent (or diluted ink) sent to the print head; means make it possible to translate this pressure variation into a viscosity variation to compensate.

According to one embodiment, said means for sending a plurality of elementary quantities of solvent to the print head make it possible to calculate:

- a duration, between 2 successive sendings of solvent (or diluted ink), enabling mixing, in the circuit, of solvent and ink sent,
- and/or a number and/or a frequency of sendings of solvent (or diluted ink), according to what has been described above.

A device according to the invention comprises for example a common pump, preferably a membrane pump, to pump ink from the ink reservoir and/or solvent from the solvent (or diluted ink) reservoir, for sending to the print head.

Selection means may be provided to connect selectively an outlet of the ink reservoir and/or an outlet of the solvent (or diluted ink) reservoir to said common pump, which is preferably single.

A device according to the invention may comprise a device or damping means for damping pressure fluctuations or undulations of ink and/or solvent (or diluted ink), from the common pump.

Such a damping device may comprise means, forming non-return valve, for preventing a circulation of ink and/or solvent to the common pump.

A device according to the invention may further comprise a third reservoir, connected to the supply circuit, for example for diluted ink.

In a device according to the invention, the first reservoir may have a first liquid outlet, for sending a first liquid (for example ink) from this first reservoir to the print head, the second reservoir having a second liquid outlet, for sending a second liquid (for example solvent) from this second reservoir to the print head, the device further comprising selection means for connecting selectively the first outlet and/or the second outlet to the potential common pump for pressurising the ink and/or the solvent for sending to the print head.

This type of circuit makes it possible to only use a single pump, to pump the two liquids, on the one hand ink and, on the other hand, solvent (or diluted ink). The means for connecting selectively the first outlet and/or the second outlet to a common pressurised pump comprise for example a valve associated with each reservoir and activated to open or to close, to make flow or send the selected liquid to the common pump.

A device according to the invention may advantageously comprise, downstream of the common pump:

- a first passage for supplying the print head with ink and/or with solvent,
- a second supply passage, parallel to the first supply passage, for supplying the print head with solvent.

Means, for example a three-way valve, may be provided to select one or the other of the 2 supply passages, as a function of the liquid. For example, the second passage may be reserved exclusively for the circulation of solvent and will be used during operations of cleaning the circuit with solvent.

Moreover, means may be provided to impose an operating pressure on the common pump, for example comprising at least one return conduit, to one of the 2 reservoirs, from at least one conduit for supplying the print head, this return conduit being arranged from a point downstream of the common pump, and potentially the device for damping pressure variations or undulations, and comprising means forming a restriction to its flow. When the device comprises 2 supply passages, such a return conduit, provided with means forming a restriction, may be provided for each of these 2 passages.

The elementary quantities can be sent in the supply circuit upstream of the print head. According to another embodiment, a device according to the invention comprises means for sending a plurality of elementary quantities, preferably diluted ink, directly into the print head, mixing between ink and diluted ink taking place in the head, but not in the supply circuit upstream of the head.

The invention also relates to an ink jet printer, comprising a device for supplying with ink and/or with solvent as defined above, and/or implementing a method as defined above.

DETAILED DESCRIPTION OF EMBODIMENTS

Figure 3A:
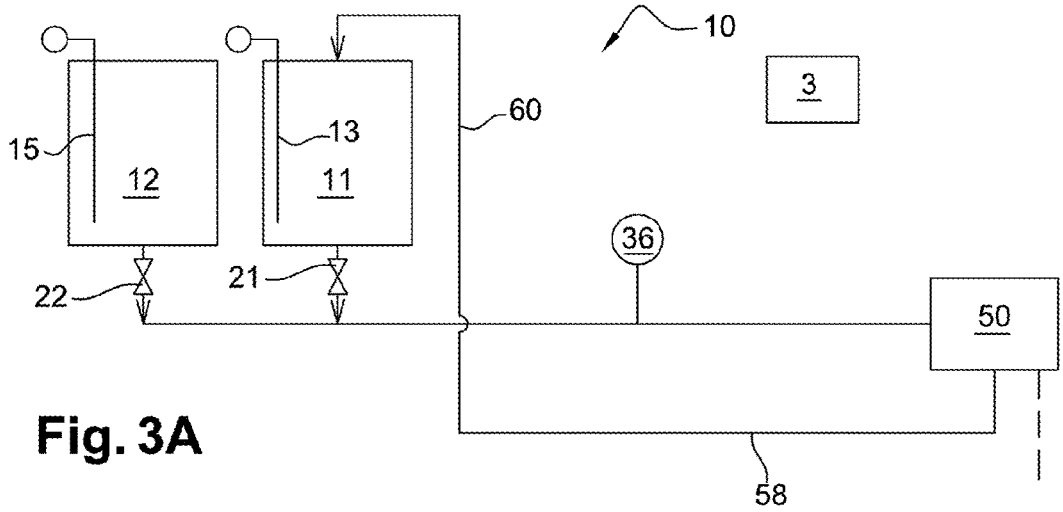
FIGS. 3A-3C represent examples of supply circuits to which the invention can be applied, FIGS. 4A-4B schematically represent the alternation of addition of solvent (and possibly of ink.
Figure 3B:
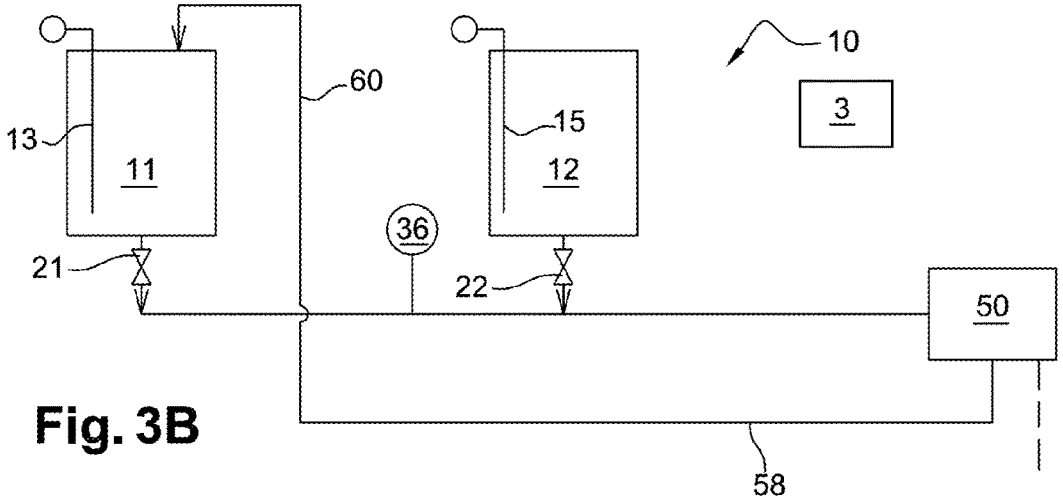
Figure 3C:
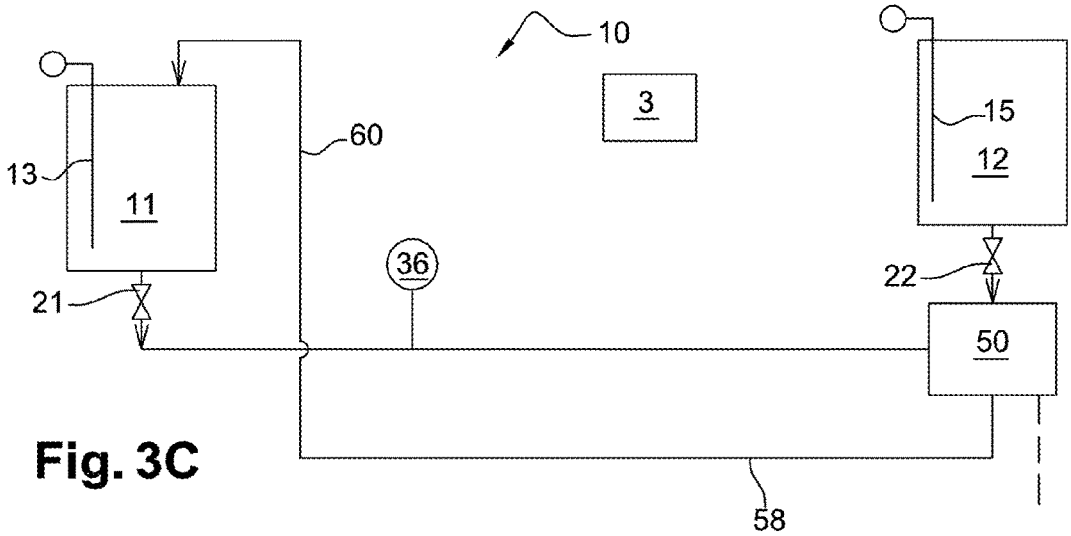

The invention may in particular be applied to a circuit structure 10 for supplying a print head 50, of the type illustrated in FIGS. 3A-3C.

This circuit comprises a first reservoir 11, for containing a first liquid, and a second reservoir 12, for containing a second liquid.

According to an application, the first liquid is ink, and the second liquid is solvent, for example of MEK (Methyl Ethyl Ketone) type. In a variant the second liquid is ink diluted (for example at a rate of 1% to 10%) with solvent.

Hereafter, reference will indiscriminately be made to a first liquid or to ink, and to a second liquid, or to solvent (but, again, the last one can also be diluted ink; the description below, given in connection with solvent, generally also applies to diluted ink).

One and/or the other of the reservoirs 11, 12 may be filled, using a fluidic circuit or, more simply, by hand, by pouring, into the reservoir, the corresponding liquid, when said liquid is in short supply. Means 13, 15 may be provided, in each of these reservoirs, for measuring the level of the liquid that it contains. Such means are for example described in WO 2011/076810.

A circuit 58, 60 is also provided to bring ink, not used during printing, to the ink reservoir 11.

At the outlet of each of these reservoirs is arranged a valve, respectively 21, 22: the more or less long duration of the opening of each of these valves defines the quantity of liquid that is withdrawn from the corresponding reservoir, as a function of the pressure and flow rate conditions at the outlet of these valves.

The management of the valves (their openings and closings) takes place preferably with a view to not perturbing the jet.

For example, according to one embodiment, the valve 11 of the ink reservoir remains open including during micro-additions of solvent (or diluted ink). In other words, in this case, ink is sent simultaneously with solvent (or diluted ink), then ink alone is sent; then the cycle is repeated one or more times: once again, ink and solvent (or diluted ink) are sent simultaneously, then ink alone, etc.

If not, pure solvent is sent, then ink alone is sent; then the cycle is repeated one or more times: once again, pure solvent is sent, then ink alone etc.

The (pure) solvent, or diluted ink, is sent into the flow of ink that has been withdrawn from the reservoir 11, at the outlet of the latter (see structure of FIG. 3B), or into the path of the ink, between the outlet of the reservoir 11 and the inlet of the print head 50 (case of FIG. 3B), or very close to, or in, the print head 50 (case of FIG. 3C).

In other words, in these structures, there is no reservoir common to ink and to solvent, in which mixing would take place, at atmospheric pressure, between these two liquids before being sent to the print head. The mixing between these two liquids is carried out in the circuit itself, thus in the elements (not represented in FIGS. 3A-3C) that constitute it, for example one or more conduits and/or one or more pumps and/or a damping device and/or one or more filters and/or one or more valves (or even simply in the print head in the case of FIG. 3C). An example of damping device which could be used in a circuit structure according to the invention is described hereafter.

In these structures, the dilution of micro-additions of solvent in the ink, or the mixing of liquids from different reservoirs, is carried out in the line for supplying the head with ink, which is in general pressurised (at the pressure imposed by a pump or pressurisation means), for example comprised between 1,2 and 10 bar (for example, again, at 1,5 bar or 2,5 bar or 3 bar or 5 bar), without prior mixing of ink with solvent, or without prior mixing of liquids from different reservoirs.

In these structures, fluid (liquid) circulates:

- under the action of pumping or pressurisation means (not represented in FIGS. 3A-3C), on the outward path, in the direction of the head 50; for the structure of FIG. 3C, two pumps are used, one for the liquid of the reservoir 11, the other for the liquid of the reservoir 12,
- and, also under the action of pumping or pressurisation means (not represented in FIGS. 3A-3C), on the return path, coming from the head 50 and to the reservoir 11.

The fluid that circulates in the circuit is ink, or a mixture of ink and solvent, during printing operations, and solvent, during cleaning operations.

The whole of the circuit is controlled by a controller, or means forming controller 3, which thus control at least sendings of ink and/or solvent (and/or diluted ink) to the head or to the circuit (by the control of the valves 21, 22 and pumping or pressurisation means), the return of the ink coming from the head 50 and to the reservoir 11 (once again by the control of valves not represented and pumping or pressurisation means), the operations of printing, but also cleaning of the circuit.

Figure 4A:
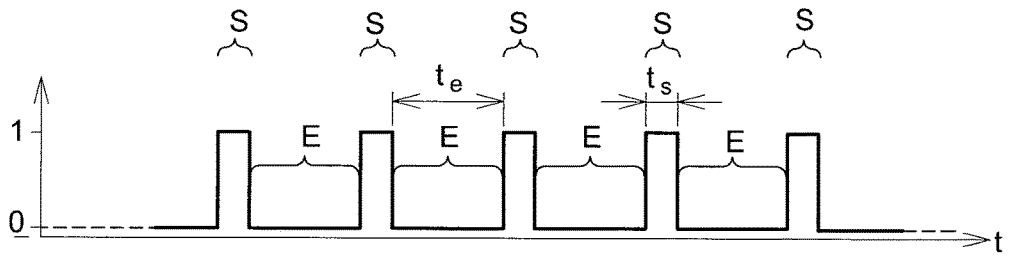
FIG. 4B), in elementary quantity, and addition of ink.

FIG. 4A represents an example of sequence of injection of pure solvent (or diluted ink) into a flow of ink, in accordance with the present invention, which may be applied to a structure as described above (FIGS. 3A-3C) or to a circuit structure described hereafter (FIGS. 5A-6D).

According to such a sequence, during one or several printing operations, or during the emission of a jet by the head 50, a plurality of elementary additions of solvent (or diluted ink) are made in the form of successive pulses, for example periodic pulses of duration $t_s$ and of period $t_e+t_s$. In FIG. 4, the crenelations, when they are at level "1", represent sendings of solvent S, each during $t_s$, between which sendings of ink E, each during $t_e$, are carried out.

Figure 4B:
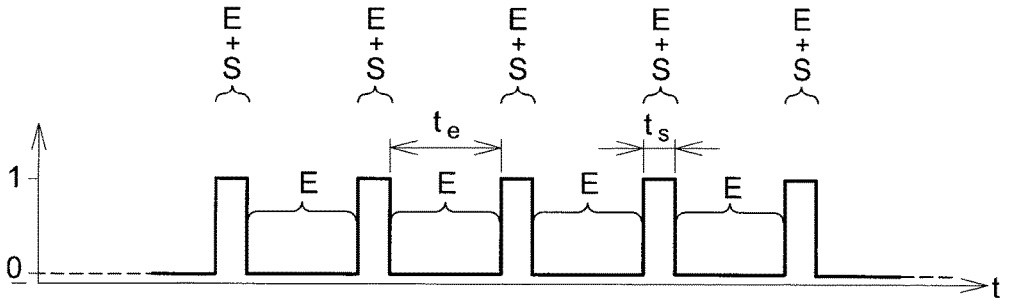

FIG. 4B represents another example of sequence of injection of solvent and ink (in a variant: diluted ink and ink) into a flow of ink, in accordance with the present invention, which may be applied to a structure as described above (FIGS. 3A-3C) or to a circuit structure described hereafter (FIGS. 5A-6D).

According to the sequence of this example, during one or several printing operations, or during the emission of a jet by the head 50, a plurality of elementary additions of solvent and ink (S+E) are carried out (in a variant: diluted ink and ink) in the form of successive pulses, for example periodic pulses of duration $t_s$ and period $t_e+t_s$. In FIG. 4B, the crenelations, when they are at level "1", represent sendings of solvent S and ink (in a variant: diluted ink and ink), each during $t_s$, between which sendings of ink E, each during $t_e$, are carried out. According to this variant, ink and solvent (in a variant: diluted ink and ink) are sent simultaneously for the duration $t_s$, and ink alone is sent for the duration $t_e$, so as to perturb the jet as little as possible.

In these FIGS. 4A and 4B, the sendings of solvent are carried out in a periodic manner. But, more generally, it is also possible to carry out sendings of solvent (or diluted ink) with variable time differences between them.

Each sending of solvent contains a small quantity of solvent (or diluted ink), of a volume for example comprised between 0.1 $cm^3$ and 5 $cm^3$, or up to 10 $cm^3$ or even 15 $cm^3$, further for example 0.2 $cm^3$, or 1 $cm^3$. As explained hereafter, the elementary volume of solvent may be more precisely defined in taking into account, notably, the dilution coefficient and/or the volume of ink in which ink—solvent mixing takes place before passing into the print head.

One advantage of sending a small unit quantity of solvent or diluted ink is the following. Too considerable additions of solvent or diluted ink may lead to too considerable viscosity variations in the circuit and in the print head, and, consequently, also too considerable variations in speed of the jet and thus instability of the speed of the jet emitted by the head 50. In order not to perturb the latter (on account of the printing operations underway), the additions are thus made by small quantities, or by addition of elementary volumes, as mentioned above. The elementary volume may be more precisely calculated so that an addition of this volume of solvent perturbs the speed of the jet as little as possible, or that it undergoes a variation less than a given limit value, for example ±1% of the speed of the jet. The ink jet, sent to a printing support, is thus little perturbed by the modification of the quality of the ink and/or by the perturbation of the breakage of the jet that result from the addition of solvent or diluted ink.

Such micro-additions are carried out successively, with a time difference $t_e$ which preferably takes account of the capacity of the circuit to carry out mixing of ink and solvent. For example, for an addition of solvent (or diluted ink) in the print head, using a device such as that of FIG. 3C, the duration of carrying out correct mixing will be shorter than in a structure such as that of FIG. 3B or even in a structure such as that of FIG. 3A (where the length of the path between the point of addition and the head gives more time so that mixing occurs). In a device such as that of FIG. 3C, it may be preferable to inject not solvent, but diluted ink, for example with a dilution rate comprised between 1% and 20%. If diluted ink is injected, having a small amount of solvent, for example with a dilution rate comprised between 1% and 5% or even between 1,5% and 4%, performing a good mixing may not be so critical. Generally speaking, the duration $t_e$ could be comprised between several fractions of second and several seconds, for example between 0.1 s and 1 s or 5 s.

Each quantity of solvent (or diluted ink) may be fixed, it is for example 0.2 cc.

In a variant, the quantity of solvent (or diluted ink) of one or more micro-additions may be different to that of one or more other micro-additions. This is the case, notably, if the first micro-addition is greater than following micro-additions, or instead if the volume of micro-additions reduces progressively, from the $1^{st}$ micro-addition to the last. In all cases, the sum of the volumes of the different micro-additions makes it possible to restore a nominal viscosity to the ink in the ink reservoir.

The maximum value of the micro-addition quantities may depend on the dilution coefficient and the volume of ink in which ink-solvent mixing occurs, before passing into the print head. For example, the total volume to add to restore nominal viscosity in the ink reservoir may depend on the following parameters: total volume of ink, dilution coefficient and operating temperature.

The number of micro-additions may also be variable; it may notably depend on the volume of ink, the dilution coefficient and the operating temperature.

Furthermore, pressure variations in the circuit for supplying the head may be detected, using a pressure sensor 36. The pressure variations detected are, in general, in particular at constant temperature and at constant jet speed, attributable to variations in viscosity of the ink sent to the head 50 of the ink by solvents. These viscosity variations are compensated by additions of solvent, but, as explained above, in a small unit quantity.

A pressure variation detected by the sensor 36 is in general due to a viscosity (or concentration) difference, according to the following relation (1):

$$\Delta P_{nozzle} = 32\frac{\Delta\mu(T)Lnozzle}{(2\ R_{nozzle})^2}V_{jet}^2$$

where:

$L_{nozzle}$ and $R_{nozzle}$ designate, respectively, the length and the radius of the emission nozzle of the jet, in the head 50;

$P_{nozzle}$ designates the pressure of the emission nozzle of the jet.

When the pressure is no longer that of the nozzle, but at another point of the circuit, it is possible to take into account additional viscous terms (which result for example from the umbilical, etc.) but these terms are negligible in view of the pressure difference at the nozzle. This is notably the case when the sensor is positioned on the jet line, in particular downstream of an anti-pulsation device (as for the examples of more detailed devices disclosed below). The sensor being on the jet line, the additional head losses are low and they can be taken into account in the self-calibration.

The above relation makes it possible to measure the variation in the quality of the ink.

In a first approximation, the density varies little with temperature and the jet speed can be slaved to a target value by action on the pressure, for example using means for pumping the ink withdrawn from the reservoir 11 (for example the pump may form part of enslavement means, comprising a sensor for measuring the jet speed in the head, for example a sensor such as described in the application PCT/EP2010/060942 or WO 2011/012641).

To guarantee good ink quality, or constant quality, a difference in viscosity, detected using the pressure sensor, may then be corrected by a volume of solvent (or of diluted ink) to add to the ink of the circuit. This volume may be calculated by taking into account the dilution coefficient, which is specific to each ink and may be formulated in the following manner:

$$C_d=(\Delta\mu/\mu)/(\Delta V_r/V_r) \quad (2)$$

which represents the relative variation in viscosity μ which results from a relative variation in the volume $V_r$ of the ink, this relative variation resulting for example from an addition of solvent (or of diluted ink).

As a function of the detected pressure variation, the quantity of solvent (or diluted ink) that may be sent to the head without perturbing the jet, and/or a number and/or a frequency of elementary quantities of solvent (or diluted ink) to add may be calculated.

Other examples of embodiment of circuits to which the invention may be applied are now described, in relation with FIGS. 5A-6D.

References identical to those of FIGS. 3A-3C designate the same elements, the description of which will thus not be repeated here.

Figure 5A:
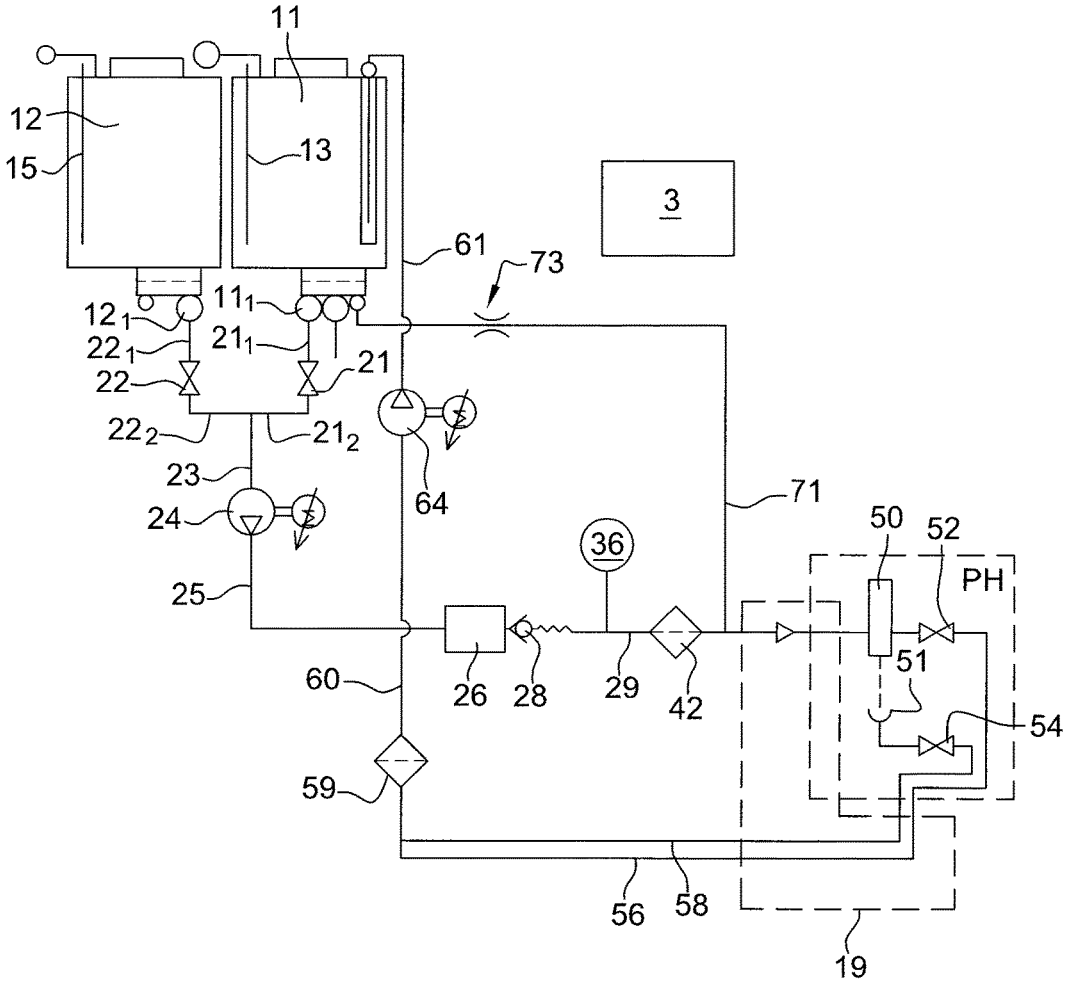
FIGS. 5A-5C represent examples of supply circuits to which the invention can be applied.

In the example of FIG. 5A, each of these reservoirs is provided with an outlet $\mathbf{11}_1$, $\mathbf{12}_1$ for the liquid that it contains.

The opening or the closing of this outlet may be regulated using a valve, respectively 21, 22: the more or less long duration of opening of each of these valves defines the quantity of liquid that is withdrawn from the corresponding reservoir, as a function of the pressure and flow rate conditions at the outlet of these valves.

Each of these two outlets brings the fluid withdrawn to a single pump 24, common to the 2 fluids, which is thus going to be able to pump, for example successively or alternatively, or simultaneously, as a function of the state of opening or closing of the valves 21, 22, ink coming from the reservoir 11 and solvent coming from the reservoir 12. A single conduit 23, downstream of the valves, may thus bring to the pump 24 liquids coming from the 2 reservoirs. In particular, solvent from the reservoir 12 is pumped by this pump 24 without going through the reservoir 11 to be mixed therein with ink; it may be sent to the print head without having been mixed with ink, or in being mixed with ink that has itself been extracted from the reservoir 11.

According to a particular embodiment, a conduit $\mathbf{21}_1$ (respectively $\mathbf{22}_1$) connects the outlet of the reservoir 11 (respectively 12) to the inlet of the valve 21 (respectively 22) and a conduit $\mathbf{21}_2$ (respectively $\mathbf{22}_2$) connects the outlet of the latter to the inlet of the conduit 23.

Known systems use a pump for each liquid, thus for each reservoir: there is then a pump to pump solvent, and a pump to pump ink. The pump which makes it possible to pump ink is constantly called upon during printing phases. On the other hand, the pump that sends solvent operates in a less constant manner, since the sending of solvent is only necessary in certain phases of use of the machine (for example to adjust the viscosity of the ink, or to carry out operations of rinsing or cleaning of all or part of the circuit). In the circuit illustrated on FIG. 5A, the single pump 24, common to the 2 liquids, is going to operate at the same rhythm as the pump, dedicated to the pumping of ink, used in known systems, that is to say practically constantly during printing phases. Consequently, although being used to pump 2 liquids, it is not more called upon than the pump dedicated exclusively to the pumping of ink in known systems.

A single conduit 25, at the outlet of the pump 24, then makes it possible to send the pumped liquid to the print head, preferably through damping means 26, or damper or "anti-pulse", which, advantageously arranged at the pump outlet 24, make it possible to dampen pressure fluctuations or undulations of liquid brought about by the operation of the pump 24 and bring these fluctuations or undulations down to several mb. On account of the pump 24, for example by playing on the opening and the closing of the valves of this pump, the flow of liquid can vary around an average value, which can lie between 2 and 6 bars and around which the fluctuations may be +/−1 bar. This undulation may be important and not very compatible with the operation of a CIJ printer. In fact the drop charging system synchronises itself on a phase of the stimulation signal set with respect to the instant when the drop separates from the jet. Yet, this instant is defined for a given jet speed; a variation in jet speed, induced by still perceptible pressure undulations, would periodically desynchronise the charge compared to the instant of separation of drops, which would perturb their trajectories and thus the printing quality. The means 26 make it possible to eliminate or to limit these effects. Such means 26 are for example described in WO 2014/154830.

A detailed description of an example of embodiment of the means 26 is given hereafter.

An outlet of the means 26 may be provided with means 28 forming non-return valve; in a variant, as explained hereafter, they are means 26 which may, themselves, integrate this function of non-return valve.

The means 28 make it possible to block any return of ink to the means 26, the common line 25 and to the pump 24. In the case of stoppage of the printing machine, ink, which would be returned to the means 26 and/or to the pump 24 and which would remain in these members throughout the duration of the stoppage, could affect the function thereof, (by sticking and/or blocking of the pump or the means 26) notably in the case of the use of a pigmented ink, the pigments of which would tend to deposit therein. A sticking or blocking of the pump 24 is all the more sensitive when this pump is the only one at the outlet of the reservoirs.

The fluid may then be sent to the print head 50 using one or more conduits 29. One or more filters 42 may be arranged in the path of the fluid, downstream of the means 26, 28. The filter(s) also contribute to the efficiency of mixing of elementary quantities of solvent (or diluted ink) with ink.

Potentially, a pressure sensor 36 makes it possible to detect pressure variations in the fluid that supplies the print head. The measurement of the pressure in the circuit, downstream of the pump 24 and the means 26, reflects the pressure in the head, and makes it possible to identify pressure variations in the circuit (thus in the head also). This measurement of the pressure is going to make it possible to detect, indirectly, variations in concentration of solvent (or of diluted ink) in the ink. Advantageously, the pressure for a nominal jet speed (for example 20 m/s) is detected. The pressure detected is compared with a reference pressure, for this same nominal speed. In the case of a lack of solvent, the potential quantity of solvent (or diluted ink) that it is necessary to add to compensate for the deviation compared to this theoretical measurement is deduced therefrom. The detection of the pressure may be carried out at regular intervals, for example comprised between 5 and 10 minutes as a function of the operating phases of the machine: this interval may be different depending on whether the printing machine is in start-up phase, or is in permanent printing regime. It is chosen so that solvent (or diluted ink), added to the ink after detection of a lack of solvent, can be mixed homogeneously with it before the next pressure measurement.

The sensor 36 is, preferentially, arranged in the head 50, but, for reasons of bulk, may be arranged on the line 29, as illustrated in FIG. 5A.

A circuit is also provided for returning ink, not used during printing, to the ink reservoir 11.

Thus, ink, recovered in the gutter 51 is pumped, using a pump 64, through one or more conduits 58, 60, 61 and, potentially, a valve 54. A filter 59 may be arranged in this return path, since the fluid is going to be returned to the ink reservoir 11, to then be reused during printing phases. A conduit 56, connected to the head through a valve 52, and re-joining the conduit 58 upstream of the pump 64 and the potential filter 59, may be used for phases of cleaning or rinsing the print head 50.

In the system described above, only 2 pumps 24, 64 are used, one for conveying ink and/or solvent to the print head, and the other for returning unused ink to the ink reservoir 11. Moreover, since the pump 24 and the "anti-pulse" device 26 are common to the two ink and solvent circuits, it results in an economy of means, and thus of cost, for this circuit.

Preferably, each of these pumps is a membrane pump, for example as described in the document WO 2014/154830. It will be recalled that the performances of such a pump are characterised by a network of curves giving the pressure or the negative pressure obtained as a function of the flow rate for different powers supplied to the motor, an example of these curves is given in FIG. 4 of the aforementioned document. In other words, a network of curves defines the characteristics of the pressure behaviour as a function of the flow rate of a membrane pump. For a given command voltage (which defines the speed of rotation of the pump), the characteristic of the pump is a decreasing function, which goes from a maximum pressure for zero flow rate up to a zero pressure for a maximum flow rate called free flow.

Means may be provided, on the supply line 29, for setting the pressure at a certain value, which is going to make it possible to set the flow rate of the pump 24, notably in the case of a membrane pump. These means may comprise a return passage, or conduit, 71. Through this conduit, part of the fluid which circulates in the line 29 is withdrawn, and this fluid is sent to the reservoir 11. This return passage is provided with a restriction 73, which locally reduces the section of the conduit in which the liquid circulates and which makes it possible to pressurise the fluid sent to the head. Advantageously, this restriction is a singular restriction, that is to say a one-off or localised narrowing of a fluidic conduit of which the length is substantially smaller than its diameter, or small in view of its diameter, and which creates a head loss insensitive to the viscosity of the fluid which passes through it. A singular restriction is a localised narrowing of a fluidic conduit of which the length L is less than its diameter d or small in view of its diameter d.

Advantageously, $L/d \leq 1/2$; according to several examples, L/D is comprised between ¼ and ½ (for example D=0.3 mm and L=0.1 mm). A restriction may be implemented, having a singular behaviour, for which L/D is greater than 1 and may reach 10 (in other words, $1 \leq L/D \leq 10$). The flow rate Q of a singular restriction depends on the pressure difference ΔP at its bounds by the relation $\Delta P = Rh(\rho) \times Q^2$, where Rh is the hydraulic resistance which depends on the density ρ of the fluid but does not depend on its viscosity. Here, the restriction 73 comprises an orifice of 0.3 mm diameter for example.

A control of the pressure may be carried out by means other than the combination of a return passage and a restriction.

For a circuit structure according to the invention, be it one of those disclosed in connection with FIGS. 3A-3C, or one of those of FIGS. 5A-6D, mean 3, comprising for example a processor or a microprocessor or a computer and/or an electric or electronic circuit, for example of programmable type, make it possible to command and/or to drive the various hydraulic means of the circuit, in particular the opening and/or the closing of the valves 21, 22, for example to carry out one or more additions of solvent, the operation of the pump 24, the opening and/or the closing of the valves 52, 54. They also make it possible to memorise and/or to process data from the level sensors 13, 15 and the pressure sensor 36 and/or to identify a blockage of the pump 24. They thus make it possible to control or command the supply of the circuit with liquids (with ink and/or with solvent) as well as the recovery of the mixture of ink and solvent from the head. They are thus programmed for this purpose. These means forming controller, or these control means, are arranged in part 5' of the system or console. These means can also make it possible to transmit printing instructions to the head.

Figure 5B:
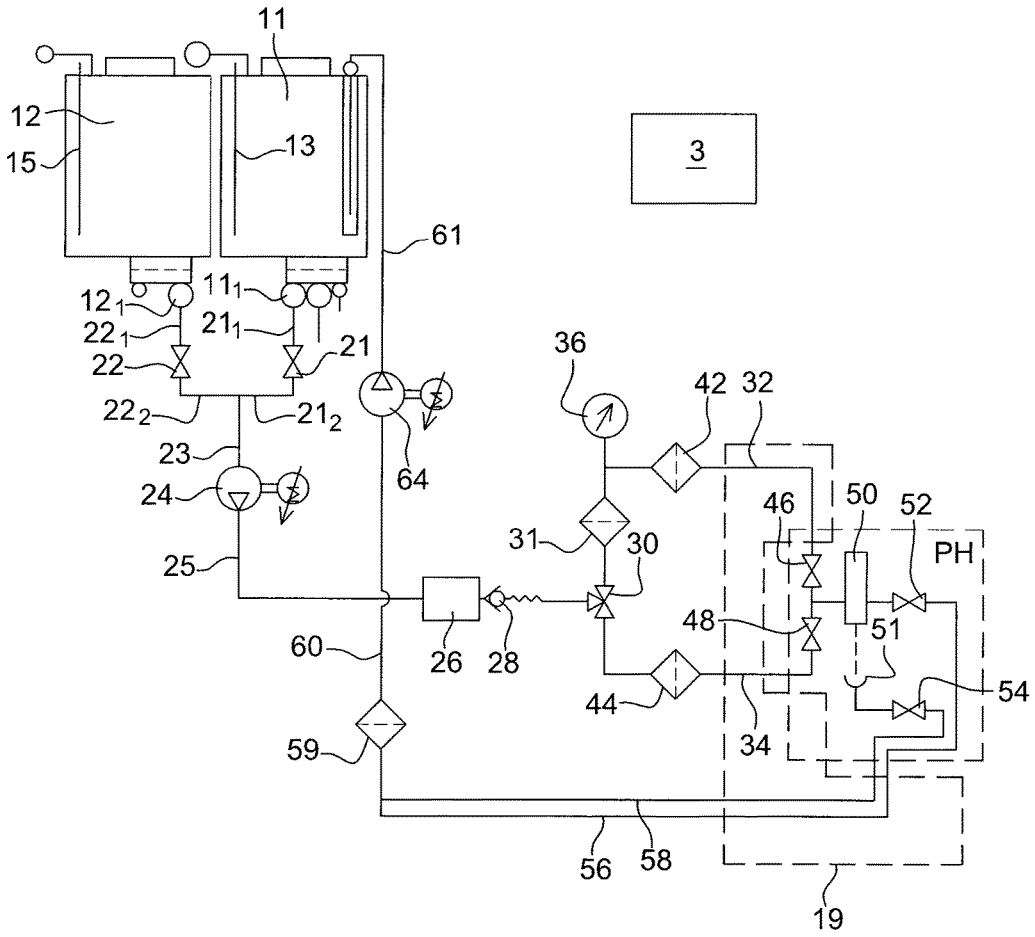
Figure 5C:
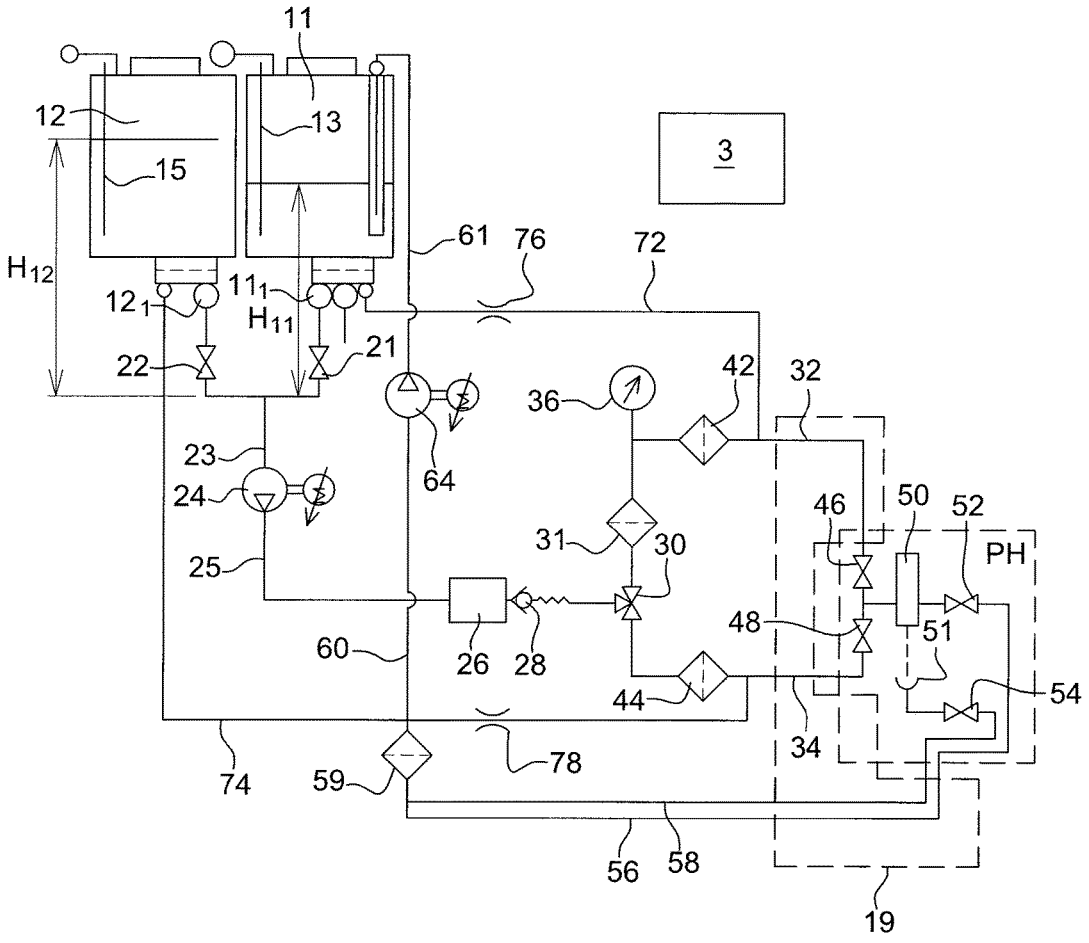

In FIG. 5A, as in FIGS. 5B and 5C, the circuit elements that form part of the umbilical 19 are represented by a broken line: here, it is part of the conduit 29 and the conduits 56, 58.

The device described above only comprises 2 pumps and 2 reservoirs.

There is no additional reservoir, downstream of the pump 24. A mixing of the 2 liquids pumped from the 2 reservoirs 11 and 12 is carried out in the parts of the fluidic circuit in which the 2 fluids flow: the conduits 23, 25, the pump 24, and the "anti-pulse" device 26.

Another example of embodiment is illustrated in FIG. 5B, which comprises all the elements described in connection with the preceding figure, which will not be re-described here. In this embodiment, means 30, for example a valve, preferably an electromagnetic 3-way valve, arranged downstream of the means 28, make it possible to select:

- a supply of the head 50 with the first liquid, or with a mixture of the first liquid and the second liquid, through a $1^{st}$ passage (or channel or conduit or duct) 32 for supplying the print head;
- or a supply of the head 50 with only the second liquid, through a $2^{nd}$ passage (or channel or conduit or duct) 34 for supplying the print head; it is thus possible to send to the print head clean solvent, not comprising, or comprising little, traces of ink.

The means 30 may be activated (using the means 3) as a function of the fluid pumped by the pump 24.

The first passage 32 may be provided with the pressure sensor 36, using which pressure variations of the liquid which supplies the head may be detected. As indicated previously, it would be, in a preferred manner, arranged in the head 50 but, for reasons of bulk, it may be positioned on the supply line 32. The functions of this sensor are the same as those which have been described above in relation with FIG. 5A.

Each of the two passages 32, 34 may be provided with means for filtering the liquid that it conveys: thus the passage 32 may be provided with filtering means 31, 42 and the passage 34 with filtering means 44.

The print head may be provided with valves 46, 48 to enable its supply, respectively by the first passage 32 or by the second passage 34. The opening and the closing of these valves may be synchronised with that of the valve 30, but this is not necessary.

Each of the passages 32, 34 comprises one or more conduits connecting the means 30 and the head 50 while incorporating the potential elements (in particular the filter(s)) described above.

In this embodiment, the means 28 make it possible to avoid the introduction of ink into the part of the circuit common to the 2 fluids (the means 26, the common line 25 and the pump 24). Thus, during a cleaning or rinsing phase, the solvent pumped to upstream of the non-return valve 28 will be preserved of any return of ink and could be sent to the line 34 without being polluted by ink.

Another example of embodiment is illustrated in FIG. 5C, which comprises all the elements described in relation with the preceding figure, which will not be re-described here.

Moreover, a return passage, or a conduit (or channel or duct), 72, 74 may be provided for each of the passages 32, 34. Through this conduit, part of the liquid which circulates is withdrawn, respectively into the passages 32, 34, and this liquid is sent back to the corresponding reservoir 11, 12. This return passage is provided with a restriction 76, 78, which locally reduces the section of the corresponding conduit and which makes it possible to pressurise the liquid sent to the head. They are preferably singular restrictions, the properties of which have already been explained above.

According to an example of embodiment, each of the restrictions 76, 78 comprises an orifice, for example of 0.3 mm diameter.

These return passages 72, 74 assure part of the security of the system: an increase in pressure occurs, for example due to the risk of blockage in the head 50, then the fluid which can no longer flow through the head is channelled through the return passage 72.

A blockage, even partial, of the restriction 76 may be detected by an increase in pressure in the circuit, for example when the pressure reaches several bars, again for example 4 bars. The sensor 36 makes it possible to detect this anomaly, or instead it is highlighted by a reduction in the speed of the motor. In the case of detection of such an anomaly, this may be signalled to an operator, and/or the machine may be stopped.

Furthermore, in the case where the pump 24 is a membrane pump, the restrictions 76, 78 make it possible to set the pressure at its outlet, which constitutes one of the operating parameters of this type of pump (as already explained above).

When ink is sent, via the pump 24 and the passage 32, to the head 50, for example around 90% to 96% of the ink returns via the passage 72, 10% to 4% being sent to the print head. The same proportions apply to the solvent, on account of the return passage 74, when it is sent to the head 50 via the passage 34. These proportions are explained by the low flow rate in the head 50.

In FIGS. 5B and 5C, the umbilical 19 comprises part of the supply passages 32, 34 and part of the conduits 56, 58.

In the embodiments that have been explained above, at least one part of the solvent circuit is identical with the ink pressurisation circuit.

A single pump 24 makes it possible to supply to the print head ink and/or necessary solvent. The solvent of the reservoir 12 is pumped by this pump 24 without going through the reservoir 11 to be mixed therein with ink; it may be sent to the print head without having been mixed with ink, or in being mixed with ink which has itself been extracted from the reservoir 12, the mixing then taking place in the elements of the fluidic circuit common to the 2 liquids, namely the conduits 23, 25, the pump 24, the damping device 26. The device described only comprises 2 pumps and 2 reservoirs, without additional reservoir downstream of the pump 24.

In a device and a method according to the invention, the dilution of micro-additions of solvent in ink, or the mixing of liquids from different reservoirs, is carried out in the line for supplying the head with pressurised ink (including in the damping device 26), without prior mixing of ink with solvent, or without prior mixing of liquids from different reservoirs. Dilution takes place at a pressure which can be comprised between 1,2 and 10 bar (for example at 1,5 bar or 2,5 bar or 3 bar or 5 bar), without prior mixing of ink with solvent, or without prior mixing of liquids from different reservoirs. In the prior art, mixing is always carried out in a reservoir at atmospheric pressure, it is this mixture that is then pressurised to be sent to the head.

Variants of the devices described above, or other embodiments, will be explained below, in particular in relation with FIGS. 6A-6D.

According to a first variant, one or more additional reservoirs are provided, beside the two reservoirs 11,12.

This third reservoir is intended to contain a third liquid, different from the first liquid and from the second liquid. According to an example, it contains a diluted ink, whereas the two other reservoirs contain, respectively, solvent and non-diluted ink. Preferably, the dilution of the ink in this reservoir 12*a* remains stable over time.

This third reservoir may be filled using a fluidic circuit or, more simply, by hand, by pouring the corresponding liquid when said liquid is in short supply.

Figure 6A:
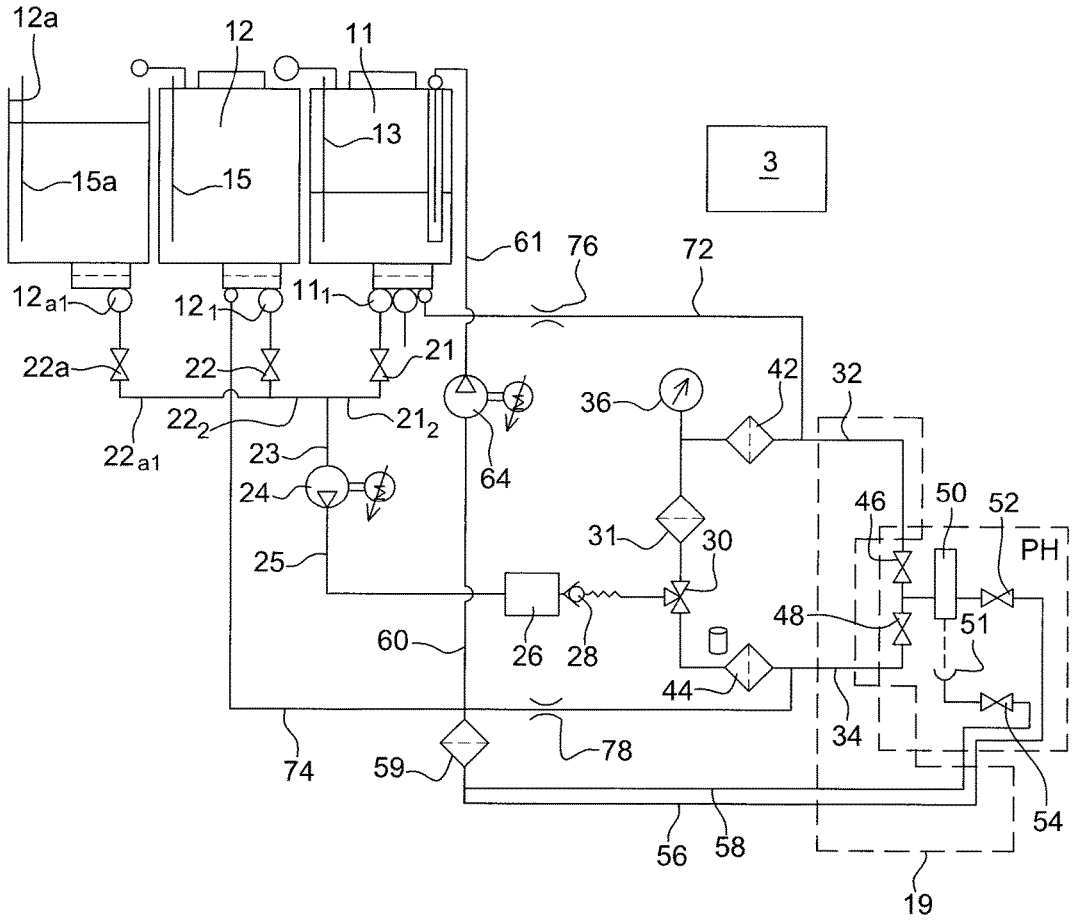
FIGS. 6A-6D represent variants or other examples of embodiment of supply circuits to implement the invention.
Figure 6B:
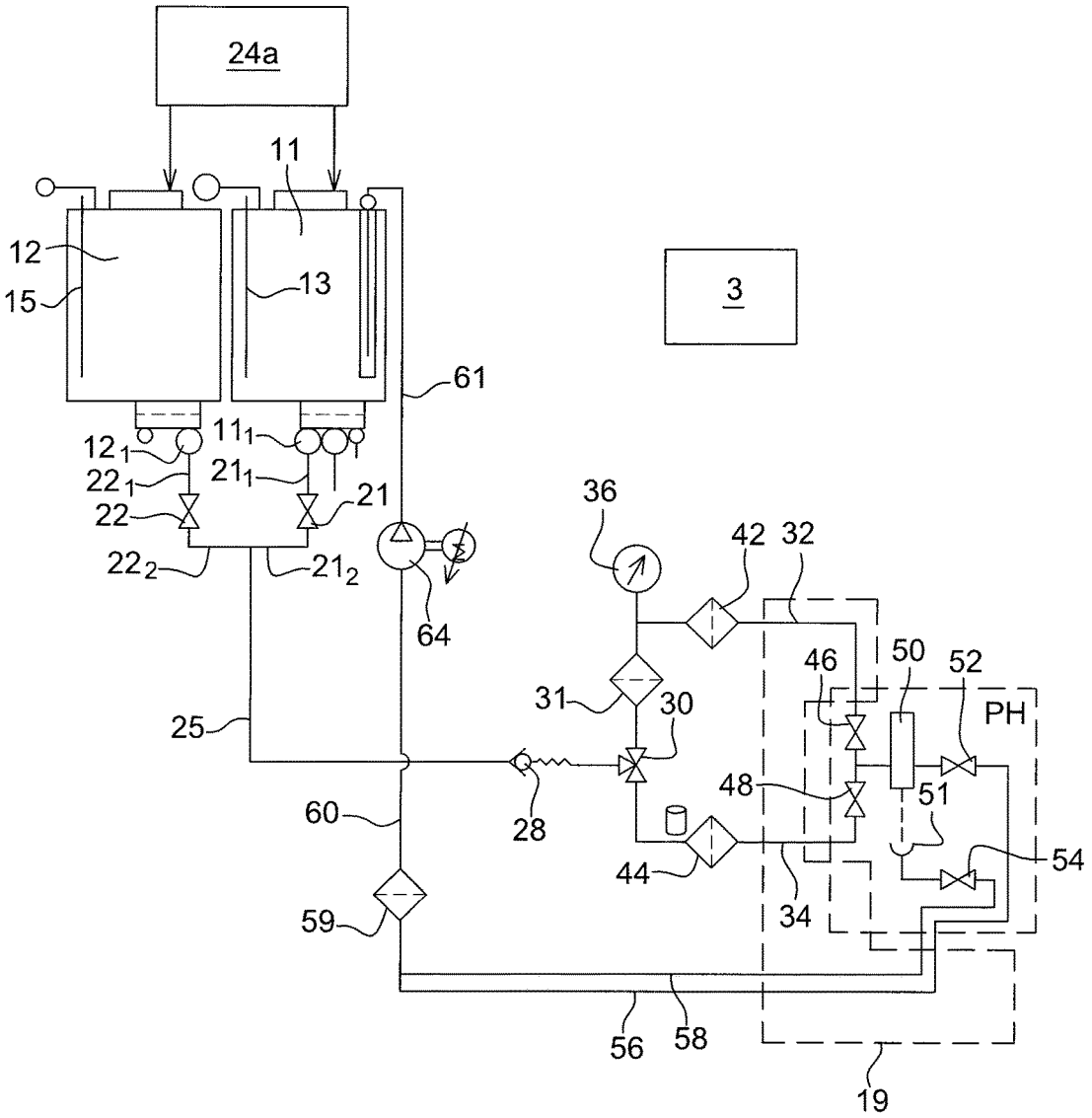
Figure 6C:
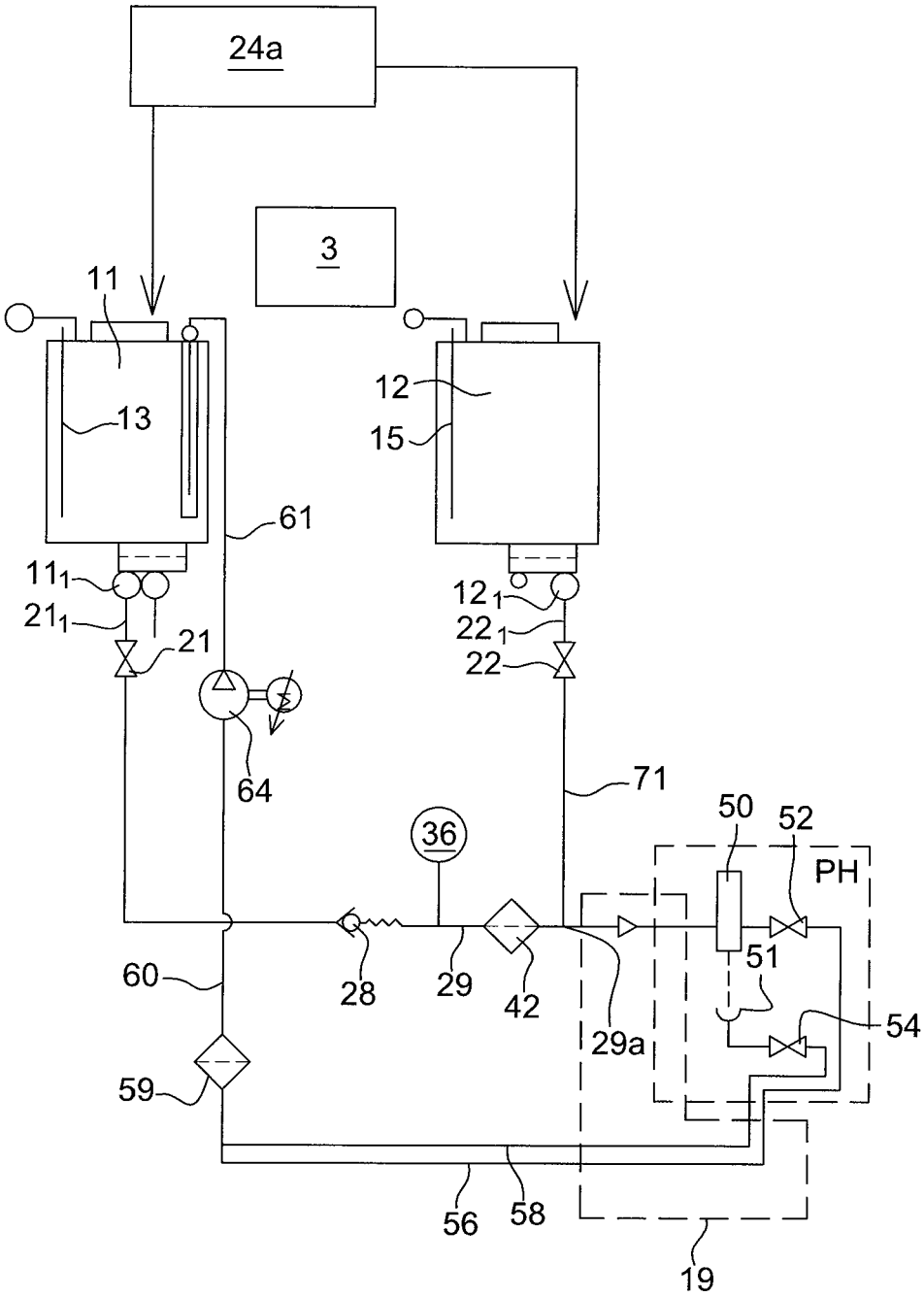

This variant is illustrated in FIG. 6A, which relates to the structure of FIG. 6C, but it is also applicable to the structures described in relation with FIGS. 5A and 5B. In this variant, an additional reservoir 12*a* is provided, comprising an outlet 12$a_1$, of which the opening or the closing may be regulated using a valve 22*a*. This outlet and this valve convey the liquid withdrawn from this reservoir to the pump 24, which is thus common to all the liquids and which is going to be able to pump, for example successively or alternatively or simultaneously, as a function of the state of opening of the different valves, liquids coming from one or more reservoirs 11 12, 12*a*. The single conduit 23, downstream of the different valves, makes it possible to convey to the pump 24 liquid(s) coming from one or more reservoirs.

Means 15*a* for measuring the level of liquid in the 3$^{rd}$ reservoir may be provided. Examples of such means are given in the document WO 2011/076810.

The valve 22*a* may be commanded or driven by the means 3, which may also collect and process data from the level sensor 15*a*.

In this variant, as in the examples already described previously, the system uses a single pump for all of the liquids. The advantages already described above are thus applicable to this variant.

According to another variant, illustrated in FIG. 6B, the different reservoirs are pressurised, for example using one or more air compressor(s) 24*a*, which makes it possible not to use a pump 24, or moreover an anti-pulsation device 26. The variant illustrated in FIG. 6B relates to the structure of FIG. 5B, but the use of compressor(s), replacing the means 24, 26, may also relate to the structures described in relation with FIG. 5A or 5C or 6A.

The mixing of the two liquids is then carried out in the part of the fluidic circuit which is common thereto, namely the conduit 25. The device now only comprises a single pump, the pump 64, which makes it possible to return ink not used for printing to the reservoir 11.

Another embodiment is illustrated in FIG. 6C, in which references identical to those of the preceding figures designate identical or corresponding elements.

This time, the two reservoirs 11, 12 are pressurised, for example with an air compressor, and are connected to a supply conduit 29 without use of a pump 24. The reservoir 12, provided to contain the solvent, may be connected to the conduit 29 at any point 29*a*, which may be situated far downstream with respect to the reservoir 11 and to the valve 21.

Figure 6D:
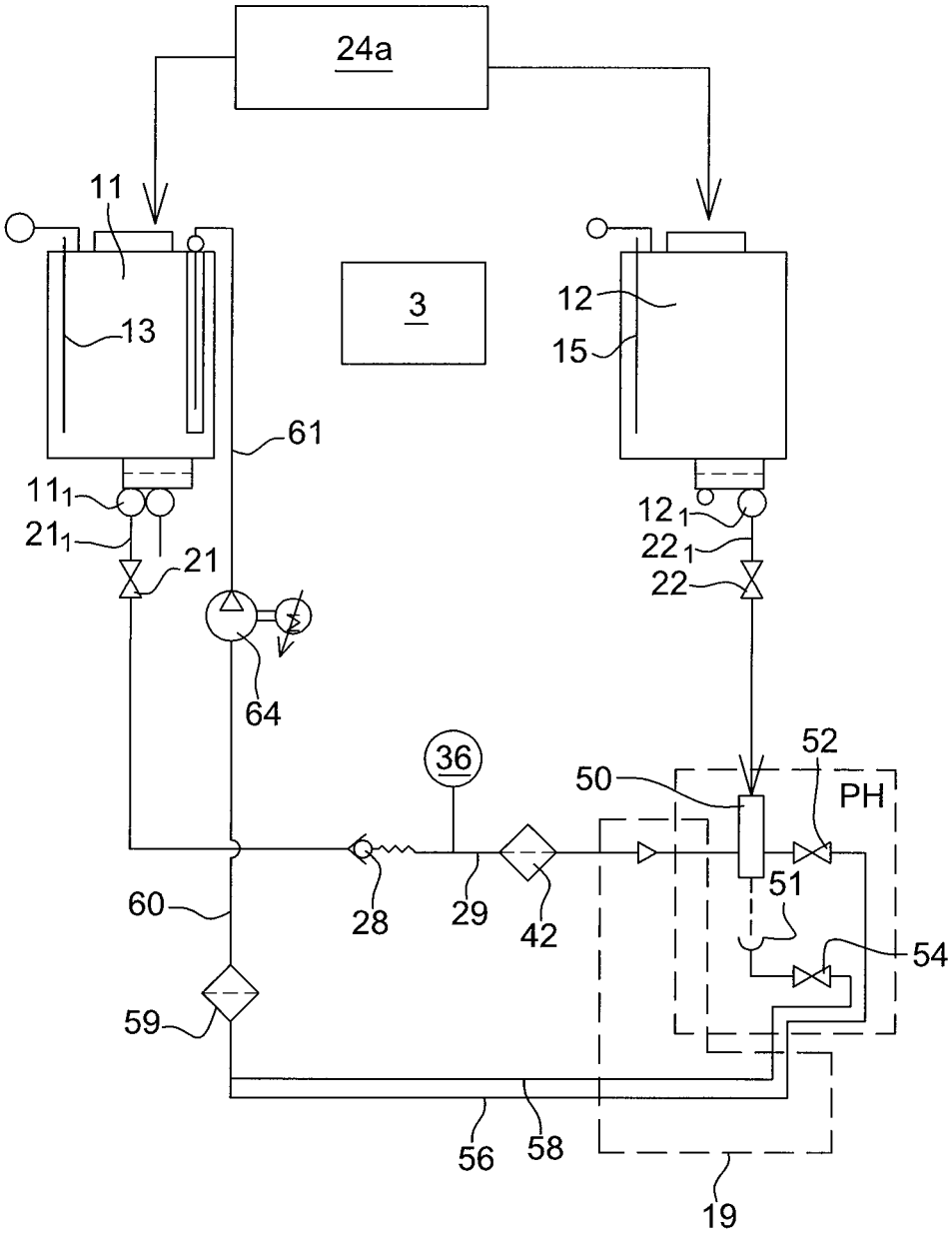

In a variant of this FIG. 6C, illustrated in FIG. 6D, the reservoir 12 is connected to the print head 50, such that the injection of solvent (or of ink, more or less diluted) may be carried out directly into the print head 50, upstream of the nozzle(s) of the head. As mentioned previously, two pumps may be used, one for the liquid of the reservoir 11, the other for the liquid of the reservoir 12.

The use of at least one additional reservoir 12*a*, containing for example diluted or concentrated ink, may also be envisaged in variants 6B-6D.

But there is no reservoir common to ink and to solvent (or to diluted ink), in which mixing would take place between these two liquids before being sent to the print head.

With each ink used in an ink jet printer may be associated a characteristic curve C which gives, for the geometric characteristics of the nozzle, the print head and the ink circuit of the printer, and for a given jet speed $V_{jet}$ (for example 20 m/s), the change in pressure (for example at the nozzle outlet) as a function of temperature. A schematic example of this curve C is given in FIG. 7A.

More particularly, the pressure, for example at the nozzle, is the resultant of the sum:

- of the dynamic pressure of the jet (term 1), of which the speed is constant and controlled;
- of the regular head losses (term 2) involving the viscosity of the ink;
- of the singular head losses (term 3) involving the density of the ink.

It is thus possible to write that the pressure, at the nozzle, during the formation of the drops, results from the sum of the above 3 terms:

$$P_{nozzle} = \frac{1}{2}\rho(T)V_{jet}^2 + 32\frac{\mu(T)L_{nozzle}}{(2\ R_{nozzle})^2}V_{jet} + \frac{1}{2}K\rho(T)V_{jet}^2 \quad (3)$$

With:

$\rho(T)$=density of the ink, expressed in kg/m$^3$;

$\mu$ (T)=viscosity of the ink, expressed in Pa·s;

$L_{nozzle}$=length (or depth) of the nozzle, expressed in m;

$R_{nozzle}$=radius of the nozzle, expressed in m;

K is a characteristic coefficient (or singularity coefficient) of the ink circuit, it may be determined experimentally or adjusted during the calibration; it is without units.

It should be pointed out that, if the pressure considered was not that at the nozzle, but at a point situated at a distance therefrom, for example upstream of the umbilical 19, as in the case of the sensor 36 of FIGS. 5A-6D, a similar formula would be obtained, by adding to the above formula a pressure term corresponding to the height difference between the console 3 and the print head 1. This added pressure term may be a parameter memorised in the printing machine, which an operator selects when he evaluates the height difference. The pressure then continues to reflect the pressure at the nozzle, or instead is representative thereof.

From an industrial viewpoint, it is difficult to guarantee the conservation of the geometric and/or mechanical parameters of a printer. For this reason, for an ink circuit having a given structure, a calibration is preferably carried out in order to eliminate variable geometric and/or mechanical tolerances from one ink circuit to another, of same structure; or, over time, following a change of components (for example a part between the sensor and the nozzle) of the ink circuit, or following a change of electronic component of the controller, a calibration of a machine, which may already have been calibrated, may be desirable.

This calibration makes it possible to carry out a correction, which consists in repositioning the reference curve C by shifting it by a pressure difference, equal to the difference between this curve C and a real operating point in reference conditions (nominal jet speed, defined during the dimensioning of the print head (in particular during the dimensioning of the stimulation)) and taking into account the characteristics of the ink), for which curve C is given, and notably a given concentration, or viscosity. The real operating point is obtained by at least one pressure measurement in the ink circuit, for example at the nozzle or at another point of the circuit, for a given temperature and for the nominal jet speed, for which curve C is given. The pressure sensor 36 may be used for this purpose. The pressure measurement will give an image of the viscosity of the ink used, this directly reflecting the concentration (or, more exactly, the dilution rate) of the ink used. A control or an enslavement of the concentration may be carried out by monitoring the viscosity parameter, which is the direct image of the quality of the ink.

The jet speed may be maintained constant, at the nominal jet speed, using the pump 24 which makes it possible to send the ink from the reservoir 11 to the nozzle or using means 24*a* in the case of FIGS. 6B-6D. The pump may form part of the enslavement means, comprising a sensor for measuring the jet speed in the head, for example a sensor such as described in the application PCT/EP2010/060942.

Figure 7A:
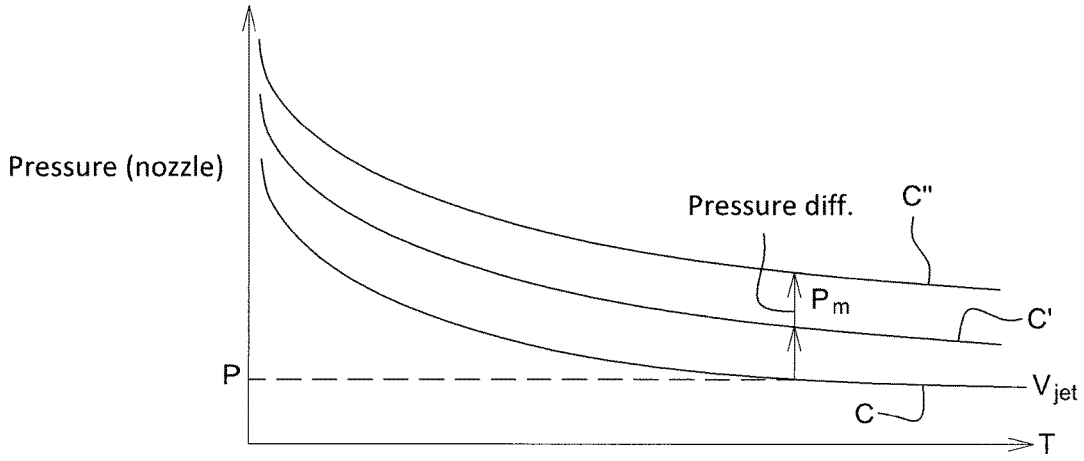
FIGS. 7A and 7B represent curves of the change in the pressure of the ink as a function of temperature.

Thus, in FIG. 7A, is represented a measurement point ($P_m$, T) which results from a pressure measurement, at a given temperature, for the selected ink and at the nominal jet speed (for example 20 m/s) for which curve C is given.

At the same temperature, curve C gives a value P. It is thus possible to obtain a new curve C', by translation of the initial curve C, by a value $P_m$−P. This difference is negative if the measurement point is situated below curve C, it is positive if the measurement point is situated above curve C. This correction may take account of variations or changes of the geometric and/or mechanical parameters of the circuit.

Furthermore, it may be seen that, according to formula (3) above, the viscosity μ of the ink intervenes to the first order, in the $2^{nd}$ term. The formula, valid for a given viscosity (designated nominal or theoretical), will be all the less valid when the real viscosity of the ink used is different from the nominal viscosity. Yet viscosity differences may exist from one batch of ink to another. In other words, the viscosity of the ink actually produced and used (visco_prod) may be different to that, designated nominal, of a "theoretical" ink having the same composition.

It will thus be understood that curve C, or even curve C', of FIG. 7A, corresponds to this "theoretical" ink, and not to the ink actually produced and used.

In order to take account of this shift of the real viscosity compared to the nominal viscosity, it is thus possible to apply a correction, which consists in repositioning curve C (or C') by shifting it by a pressure difference, proportional to the difference between the viscosity actually used (visco_prod) and the nominal viscosity visco_nominal (cP)−visco_prod (cP):

$$\text{Diff_pressure(mbar)}=A*(\text{visco_nominal}(cP)-\text{visco_prod}(cP))$$

In this formula, A is a coefficient of proportionality.

If it is wished to take into account the above 2 corrections, curve C is shifted by a pressure difference which adds together the 2 correction values:

$$\text{Standard pressure}-\text{reference pressure}+\text{Diff_pressure}$$

A new curve C" is obtained, by translation of the initial curve C, by a value equal to this pressure difference.

A calibration may thus be carried out which takes account of the real viscosity of the ink actually produced and used.

A method for calibrating a device or a circuit as described in the present application may thus, according to the above teaching for a given ink and for a predetermined jet speed value (for example 20 m/s), take into account the difference between the real viscosity of the ink used and the viscosity, designated theoretical, which is the parameter normally used.

Preferably, such a method takes into account, also, the correction (equal to the difference in standard pressure−reference pressure) which takes account of variations in the geometric and/or mechanical parameters of the circuit used.

Such a calibration may be carried out before starting actual printing operations, but, as regards the correction which takes account of variations in the geometric and/or mechanical parameters, after having started the printing machine and while producing a jet at the constant speed retained (nominal speed).

Instructions, for carrying out at least one of the above calibration steps are implemented by the control means 3 (also called "controller"). In particular, it is these instructions that are going to make it possible to make solvent circulate in view of a measurement of a pressure $P_m$, to memorise this measured value, to calculate the pressure difference $P_m$−P, and/or to calculate the pressure difference proportional to visco_nominal (cP)−visco_prod (cP).

The control means 3, already described above, may assure the memorisation of data relative to curve C (for example a set of pairs of values (P, T) associated with a nominal jet speed) and/or data that result from the correction(s), according to what has been explained above, of data relative to the curve. Physical and/or chemical data relative to the ink actually used, and in particular its viscosity (designated above by "visco-prod"), may be memorised in a memory of these same means 3.

A calibration as described above may be followed by a printing by the printer, the jet of ink being formed at a reference, or nominal, speed, the pressure of the ink being able to be enslaved to reach the pressure that results, preferably, from curve C".

Figure 7B:
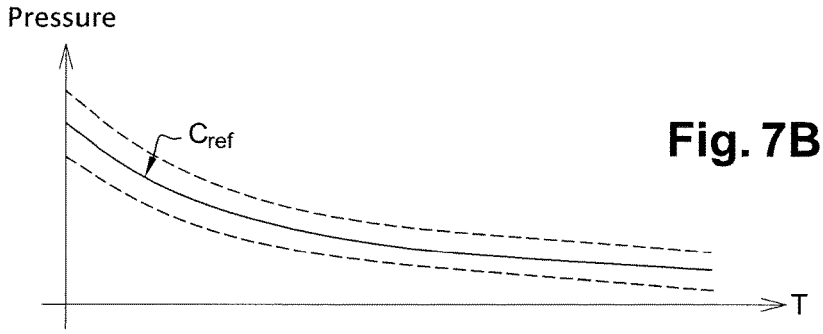

Once a calibration has been carried out, this gives a reference curve $C_{ref}$ such as that of FIG. 7B, which shows the change in pressure as a function of temperature. It may be one of curves C' or C" mentioned above. In broken lines are represented the acceptable pressure fluctuation limits, for example ±225 mbar, on either side of this curve.

Whether such a calibration has been performed beforehand or not, the viscosity of the ink used changes during the use of the machine.

Measurements of pressure variations taking place in the ink circuit are going to make it possible to measure variations in this viscosity. In fact, at constant temperature and at constant jet speed, a pressure variation is essentially proportional to a viscosity variation, as explained above.

It is thus possible to estimate, at a given temperature, and for a fixed jet speed, pressure variations in the circuit. The pressure sensor 36 may be used for this purpose, it is preferably the same as that used for the calibration, as explained above, if it is implemented beforehand.

Such a pressure variation will be indicative of a variation in viscosity, other parameters of the circuit, and notably the jet speed, being constant. Beyond such a difference with respect to curve Cref (when this is positive) or, more generally, with respect to a targeted viscosity, solvent, or ink diluted with solvent, is thus injected.

A pressure difference between the value of the pressure sensor and that given by the reference curve $C_{ref}$, or that corresponding to a desired or target viscosity, is due to a viscosity (or concentration) difference, according to the relation (1) already given above.

In the case of the structures described above in relation with FIGS. 5A-6A, the quantity of solvent to add may result for example from the following relation (4), which gives the duration of opening T of the valve 22:

$$T(s) = \frac{1}{Cd(A * P_{ref}(T, bar) - B) * Q_{transfer}(\text{cc/s})} * \Delta P(\text{mbar}) \quad (4)$$

A and B depend on the real volume of ink, A=1000/volume of ink, B=2290/volume of ink (in the reservoir 11) (these coefficients are hydraulic coefficients);

$P_{ref}$=reference pressure at the temperature of the nozzle, expressed in mbar, for a nominal jet speed of, for example, 20 m/s;

ΔP=difference between the pressure and the reference pressure, expressed in mbar;

Q is the transfer flow rate of the pump 24, which depends on the levels of fluid in each of the reservoirs 11 and 12 (the latter, $H_{11}$ and $H_{12}$, are shown schematically in FIG. 3C.

It may be seen that the quantity of solvent to add takes account of the effects of dilution on the viscosity of the ink via the dilution coefficient.

But too considerable pressure variations may lead to variations in the speed of the jet which are also too considerable and thus instability of the jet speed.

In order not to perturb the latter, the additions are made by small quantity, or elementary volume, the additions being able to be repeated during a viscosity correction sequence, until the desired effect is obtained. For example the additions are made by elementary quantities comprised between several tens of $cm^3$ and 1 $cm^3$ or several $cm^3$, further for example between 0.1 $cm^3$ and 1 $cm^3$.

The addition of solvent in the conduit for bringing ink to the head dilutes the ink and causes a variation (instantaneous (for an addition of solvent), once the mixture arrives at the jet) in viscosity at the level of the jet, which is not compensated immediately by the pressure regulation (which, for its part, compensates the evaporation of solvent). The jet, and in particular the breaking up of the jet, reacts as if it was subjected to a pressure difference which corresponds, as explained above, to a correction making it possible to compensate this instantaneous variation in viscosity. In other words, the effect of the instantaneous variation in viscosity on the breaking (in particular its position in the charge electrodes) is equivalent to the effect of the pressure difference making it possible to compensate this variation in viscosity. In current CIJ printers, the tolerance regarding peak to peak pressure fluctuations inducing tolerable breaking fluctuation may be of the order +/−1% of the reference pressure. The above relation (1), makes it possible to translate this maximum pressure fluctuation into maximum tolerable viscosity difference Δμ; the relation (2), above, giving the dilution coefficient $C_d$ of the ink, then makes it possible to translate this viscosity difference 4μ into volume of pure solvent $\Delta V_S$ diluted in a given volume $V_e$ of ink.

The flow rate of the pump makes it possible to estimate the duration of opening T(s) of the valve 22 to obtain a quantity at most equal to $\Delta V_5$. More precisely, the flow rate in the line that connects the reservoir 12 to the conduit 23 is determined, taking account of the flow rate between the reservoir 11 and the conduit 23, as well as the flow rate of the pump 24, the pressures in the conduits $\mathbf{21}_2$ and $\mathbf{22}_2$ being considered as equal (because these 2 conduits are both connected to the same conduit 23). These pressures, and thus flow rates, are going to depend on the heights of liquid in the 2 reservoirs.

The above duration T(s) (total duration of opening of the valve 22), which makes it possible to add the volume of solvent for the complete correction of the viscosity of the ink present in the machine), divided by the opening duration $t_s$ gives the number of openings of this valve 22.

According to an example, the elementary volume, 0.2 cc, is calculated so that a variation of 0.19 cps in viscosity is obtained i.e. a pressure variation of around 12.96 mbars (which does not perturb the operation of the print head).

The above formula (4) may give a very long time when the reference pressure drops below a certain limit, for example 2.4 bars. The reference pressure may thus be limited so as not to reach this lower value. Similarly, if the pressure differences ΔP are significant and lead to a calculated duration T greater than a certain limit value, for example 20 seconds, then T may be limited to this value. If necessary, the correction may be repeated.

The time at the end of which the ink and the added solvent are correctly mixed in the circuit is also known (in fact: in the volume in which they are going to be able to mix, before arriving at the print head), for example 15 s. This mixing time makes it possible to determine the duration $t_e$ between 2 injections of a small quantity of solvent.

As explained above, the additions are made by small quantity in order to limit pressure variation. In order not to perturb the jet, the pressure variation is preferably less than 1% of the reference pressure. The above equation (1) makes it possible to translate this pressure variation limit into a viscosity variation limit value; given the numerical values commonly used, the equation (1) may thus lead to a maximum variation in viscosity comprised between 4% and 10%.

Equation (2) then makes it possible to translate it into a volume of solvent (or diluted ink) $\Delta V_s$ that may be added to a volume of ink $V_e$ in which it will be mixed before sending to the print head.

For numerical values commonly used in this field, equations (1) and (2) may lead to a maximum variation of $\Delta V_s/V_e$ comprised between 1.5% and 4%, for example for a standard ink based on methyl ethyl ketone (MEK) (case of an addition of pure solvent to a standard ink). The use of a wider range of inks leads to a maximum variation of $\Delta V_s/V_e$ comprised between 1% and 10%.

The volume of ink between two additions of solvent may be calculated or estimated using the above percentages: the volume $\Delta V_s$ of an elementary addition of solvent preferably does not exceed 1.5% to 4% of the volume of ink sent to the head. In other words, each elementary addition of solvent has a volume that is preferably comprised between 1.5% and 4% of the volume of ink sent before this sending of solvent, but after the elementary addition of solvent that has immediately preceded, or between this sending of solvent and the elementary addition of solvent that immediately follows; or instead, between 2 successive elementary additions, each of volume $\Delta V_s$, is sent a volume $V_e$ of ink, $\Delta V_s/V_e$ being preferably comprised between 1.5% and 4%.

In the case of a diluted ink, these values will be adjusted in a proportional manner as a function of the proportion of solvent present in the ink. In the preceding calculation, $\Delta V_s$ concerns pure solvent. If, for example, an ink is diluted 50%, a double volume of diluted ink could be added.

A numerical application may be given as an example, enabling a maximum variation in viscosity of 8%, with Cd=2.6.

Then the maximum value of $\Delta V_s/V_e$ is 3.2%, for a volume of ink $V_e$ of 15 $cm^3$, in which mixing can occur before passing into the head.

Then the maximum value of $\Delta V_s$ is 0.5 $cm^3$.

In order to limit the variation in viscosity to the above value, the minimum time $T=t_e+t_s$ between 2 additions is given by the renewal time of the ink of the volume.

For example, the value $\Delta V_s1=0.4$ c $cm^3$ may be chosen for the volumes of micro-additions of solvent. The duration $t_s$ is deduced therefrom as a function of the flow rate of solvent.

For example, for a value of flow rate of solvent of 0.5 $cm^3/s$, $t_s=t_s1=0.8$ s and, for a value of flow rate of ink of 0.5 c $cm^3/s$, the renewal time of the ink of the mixing volume $V_e$ before the head supplies the minimum value of $T=T_1=30$ s.

In one embodiment, the flow rate of ink is 1 $cm^3/s$ when the solvent electromagnetic valve is closed and spread out between ink and solvent (as a function of the heights $H_{11}$ of ink and solvent $H_{12}$ in each of the reservoirs) when the solvent electromagnetic valve is open, i.e. on average 0.5 $cm^3/s$.

This leads to conserving the same values, except for the renewal time of the ink, which then becomes 15 s, hence $T_1=15$ s.

In another embodiment, the volume $V_e$ corresponds to the common line (volume before the separation of the line that goes to the head and the line that returns to the ink reservoir). In the other cases envisaged in the present application, this volume corresponds to the line going from the point of addition of solvent up to the head.

In a variant, for better dilution of the solvent, the addition quantities may be reduced and spread out over the renewal time of the ink in the volume $V_e$.

Thus, it may be chosen to make n additions of value $\Delta V_s2=\Delta V_s1/n$. Then, $t_s2=t_s1/n$ and $T2=T_1/n$ so as to respect globally the variation in viscosity. The diagram of FIG. 4A or 4B may be adapted in consequence.

For example, for n=2, micro-additions of 0.2 $cm^3$ are then obtained, obtained by the opening of the electromagnetic valve during $t_s=0.4$ s every 15 s up to the addition of the desired quantity of solvent.

Generally speaking, the volume $V_e$ considered depends on the configuration of the ink circuit.

This volume is composed of a line comprising one or more elements of the line going to the head in which mixing can take place.

Preferably, an element enabling mixing is arranged in the path of the fluids, on the line to the print head.

Such an element comprises for example an inlet arriving on a surface on which the incoming liquid is going to spread out and which is going to reduce the speed of the flow of fluid, thus enabling mixing, an outlet far from the inlet in order to avoid any direct flow from the inlet to the outlet, and a volume in which mixing is going to take place.

For example, a filter (such as the filter 42) or a damping element (such as the element 26) form a mixing element.

Preferably, the calculation of the mixing time takes account of the fact that, in the case of the circuits described above in relation with FIGS. 5A-6A, the means 26 and/or the filter 42 contribute advantageously to the mixing of ink and added solvent (or diluted ink). These means for damping pressure fluctuations and/or the filter(s) contain an internal volume that enables mixing of ink and a small quantity of added solvent (or diluted ink). In the case of other circuits, the potential presence of components that can contribute to mixing of ink and added solvent (or diluted ink) will be taken into account.

It is thus possible to make a plurality of elementary additions of solvent (or of diluted ink) to compensate a pressure variation detected in the circuit, in the form of successive pulses, for example periodic pulses of duration $t_s$ and of period $t_e.+t_s$, which is represented in FIG. 4A or 4B, where the crenelations, when they are at level "1", represent sendings of solvent S (or of diluted ink), or of solvent S and ink E, each during $t_s$, between which sendings of ink E, each during $t_e$, are carried out.

According to a more detailed example:

the elementary addition of solvent is 0.2 $cm^3$;

$C_d=2.6$;

A=1.63 and B=3.74;

$V_{added}$ (designates the total volume of added solvent)=29 $cm^3$;

$N_{cycles}$ (designates the number of cycles of addition of solvent)=144;

Pref=2.7 bar;

$\Delta P=50$ mbar.

In the case of the structures described above in relation with FIGS. 6B-6D, the explanations given above, concerning the link between pressure variations and viscosity variations, up to, and including, formula (3), remain valid. A formula similar to formula (4) above may thus be established, on the basis of the flow rates which result from the action of the compressor(s) 24*a*, the quantity of solvent to add preferably taking account of the effects of dilution on the viscosity of the ink via the dilution coefficient.

For these structures of FIGS. 6A-6D, as already explained above, too considerable pressure variations may lead also to too considerable variations in speed of the jet and thus instability of the speed of the jet. In order not to perturb the latter (on account of printing operations underway), the additions are thus made by small quantities, or by addition of elementary volumes, according to the examples already given above.

Given the flow rate resulting from the action of the means 24*a*, the duration of opening $t_s$ of the valve 22 to obtain this quantity is deduced therefrom. More precisely, the flow rate in the line which connects the reservoir 12 to the conduit 23 is determined, while taking account of the flow rate between the reservoir 11 and the conduit 23, as well as the flow rate imposed by the means 24*a*, the pressures in the conduits $\mathbf{21}_2$ and $\mathbf{22}_2$ being considered as equal (because these 2 conduits are both connected to the same conduit 25) and being calculated taking account of the liquids heights $H_{11}$ and $H_{12}$ in reservoirs 11 and 12.

The above duration T(s), divided by this opening duration gives the number of openings of this valve 22.

Consequently, during printing operations on one or more printing support(s), it is possible to make, for example using different devices which have been described above, additions of solvent in very small quantity (also called "micro-additions"); each micro-addition has for example a volume less than several cubic centimeters, or even 1 $cm^3$; or instead, it is comprised between 5 $cm^3$, or 1 $cm^3$ and 0.01 $cm^3$ or 0.05 $cm^3$. Such micro-additions are carried out successively, with a time difference $t_s$ which preferably takes account of the capacity of the circuit to carry out mixing of the ink and the solvent. For example, for an addition of solvent in the print head, using a device such as that of FIG. 6D, the duration of carrying out correct mixing is shorter than in a structure such as that of FIG. 6C or even in a structure such as that of the preceding FIGS. 5A-5B. Generally speaking, the duration $t_s$ could be comprised between several fractions of second and several seconds, for example between 0.1 s and 1 s or 5 s.

Figure 8:
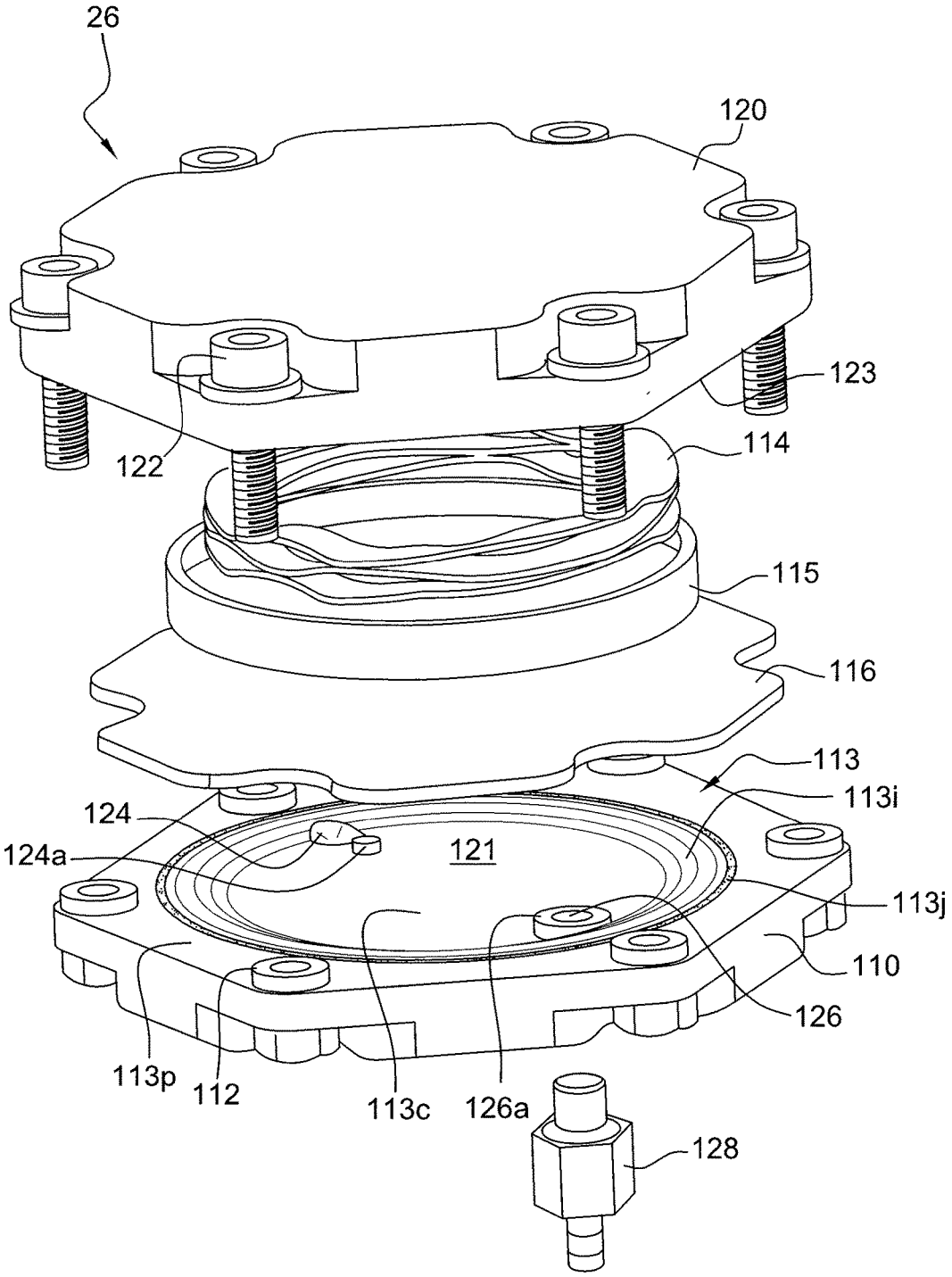
FIG. 8 represents a device for damping pressure variations according to the invention.

An example of embodiment of the means 26 will now be detailed, in relation with FIG. 8. Such an anti-pulsation device may for example be used in a circuit such as has been described above, but also in any other fluidic flow circuit, in particular for an ink jet printer, in which pressure variations of the fluid may become manifest. Such another circuit is for example described in WO 2014/154830.

This device 26 may have, in bottom or top view, a substantially circular shape or that of a regular polygon. It comprises 2 parallel plates 110, 120, assembled together, at their periphery, by means 112,122, for example a set of threaded or tapped holes and screws, preferably regularly spread out on the periphery of the device. Each of these plates may have the aforementioned substantially circular or regular polygon shape; the polygonal shape, here hexagonal, of the plate 120 may moreover be seen, in FIG. 7.

Each of the plates comprises an inner face 113, 123 of which the peripheries 113*p* or the flat, lateral portions, come opposite each other when the 2 plates are assembled using the means 112, 122.

The inner face 113 of the plate 110 is hollowed out, its central surface or its central part 113*c*, preferably flat, being lowered with respect to its periphery 113*p*, an intermediate portion 113*i* leading gradually from this periphery to the central part. The inner face of the plate 120 may also be hollowed out, for example in the same way as the inner face 113 of the plate 110, to receive a part of the spring 114.

Between these plates is defined a volume 121 for receiving fluid which enters via a $1^{st}$ opening 124 (which passes through the plate 110) and exits from this volume via a $2^{nd}$ opening 126 (which also passes through the plate 110) and an outlet connection 128. The receiving volume is around several cubic centimeters, for example comprised between 1 $cm^3$ and 10 $cm^3$, again for example 4 $cm^3$.

A spiral spring 114, makes it possible to dampen pressure variations of the fluid when said fluid is in the cavity. Other means may be employed, instead of a spring, to assure this function, for example a mass of material having elastic properties or an air bubble, enclosed in the cavity; for these other means, the structure of the cavity may remain the same as that described above. In the case of the spring, one end thereof comes to bear against the inner wall 123 of the plate 120. Its other end is turned to the inside of the cavity. But pressure variations are transmitted to it by a rigid lower plate, or cover 115. This spring is going to make it possible to dampen pressure variations, the device thus assuring an "anti-pulsation" role.

Between this plate 115 and the interior of the cavity is arranged a membrane 116, made of a supple or flexible material, for example an elastomeric material. Preferably, this membrane extends over the whole surface of the cover 115, and even beyond the periphery thereof, so as to come to bear against the periphery 113*p* of the lower plate 110. This periphery may comprise a seal bearing surface 113*j* against which the membrane 116 comes to bear when the elements 122 maintain the two plates 110, 120 assembled. Thus, this membrane 116 may form a seal to assure the leak tightness of the device.

A volume for receiving 121 the fluid is delimited by this membrane 116 and by the central surface 113*c* of the plate 110, this surface forming the bottom of the reception volume.

Moreover, an annular lip 126*a* is provided around the orifice 126. This annular lip has a certain height with respect to the bottom 113*c* of the reception volume. Its upper part is flat, such that the membrane 116 is going to be able to come to bear against it, under the action of the spring 114. Furthermore, a pin 124*a* is situated near to the orifice 124. This pin has a height equal to that of the annular lip 126 with respect to the bottom 113*c*. The membrane 116 will come to bear against the upper surface of this pin, under the action of the spring 114. But, this pin being situated beside the orifice 124, said orifice then remains open, which enables the introduction of a fluid in the inner volume, even when the membrane 116 is bearing against the upper surface of each of the elements 126*a*, 124*a*.

This configuration makes it possible to oppose the fluid, which would come back from the downstream part of the circuit via the element 128 (and which would thus circulate in the direction opposite to the direction of normal circulation of the fluid in the circuit), the presence of the membrane 116, which is bearing against the element 126*a* with a pressure which depends on the characteristics of the spring 114. This fluid must thus have sufficient pressure to raise the membrane 116, before being able to introduce itself into the inner volume of the device.

On the other hand, the fluid which flows, from the reservoir 11, 12, to downstream of the circuit, can enter via the orifice 124, without this being sealed by the membrane 116. This fluid, which thus enters under pressure in the inner volume 121 of the device, is going to be able to push back the membrane 116 and compress the spring 114, which is thus going to absorb pressure variations, then is going to flow through the orifice 126, which is freed on account of the action of the pressure of the fluid on the membrane 116. Consequently, this fluid enters firstly into the interior of the device and may then raise the membrane 116 to free the outlet orifice and flow in the normal direction of circulation of the fluid in the circuit.

The anti-pulsation device so designed thus comprises or contains means enabling it to assure a function of non-return valve, while damping pressure fluctuations of the fluid which enters therein via the orifice 124. As already described above, several anti-pulsation devices may be in series, or chain-linked, in order to obtain greater damping.

Figure 1:
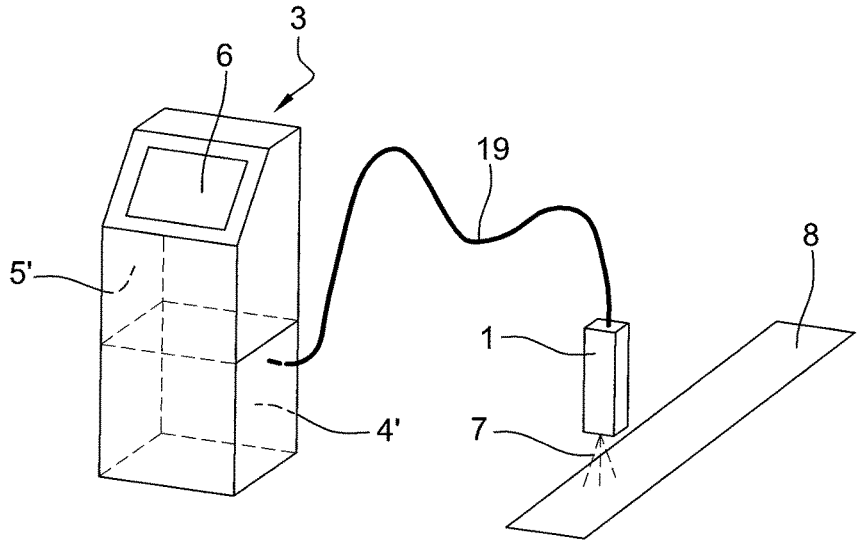
FIG. 1 represents a known structure of printer.
Figure 2:
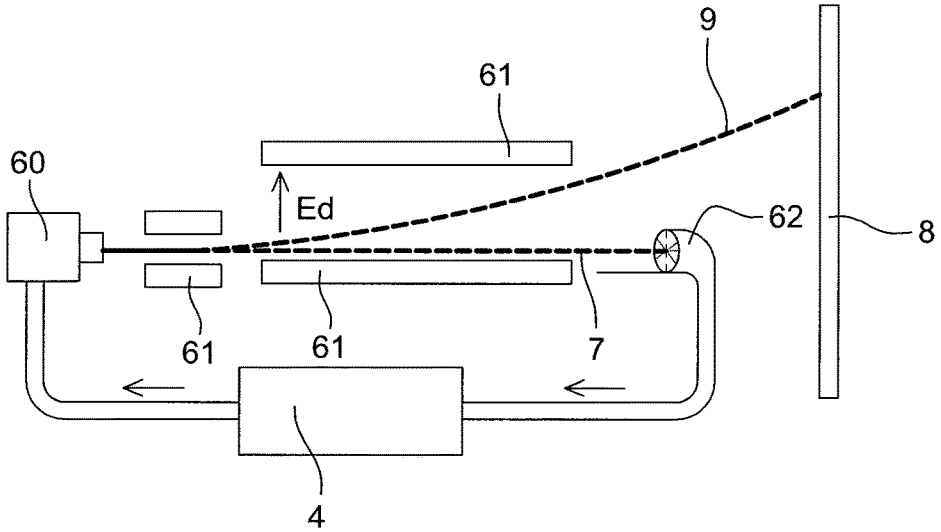
FIG. 2 represents a known structure of a print head of a CIJ type printer.

The invention may be implemented in a printer such as that described above in relation to FIG. 1. Said printer comprises notably a print head 1, generally off-centre with respect to the body of the printer, and connected thereto by means, for example in the form of a flexible umbilical 2, grouping together hydraulic and electric connections enabling the operation of the head.

Means forming controller or control means have been mentioned above.

These means comprise for example a micro-computer or a micro-processor and/or an electronic or electric circuit, preferably programmable, which is going to transmit printing instructions to the head but also drive the pumps 24, 64 or the motors and/or the valves 21, 22, 52, 54 of the system in order to manage the supply of the circuit with ink and/or with solvent as well as the recovery of the mixture of ink and solvent from the head.

They can also collect level information supplied by the means 13, 15, 15*a* for measuring the level in the reservoirs 11, 12, 12*a* and, potentially, trigger corresponding alarms. They can also collect pressure information provided by the sensor 36 and, potentially, adapt the sending of solvent, for example according to quantities and a predetermined or calculated frequency as explained above, in order to adapt the viscosity of the ink in the circuit.

The means 3 are thus programmed according to the functions that have to be managed in the printer. These means forming controller, or these control means, are arranged in the part 5' of the system or the console.

The invention claimed is:

1. Method for controlling an ink quality of an ink jet printer, during printing, said printer comprising at least one ink reservoir and a solvent or diluted ink reservoir, a print head and a supply circuit for sending ink and/or solvent to the print head, method in which:

a correction volume of solvent, or diluted ink, to add to the ink to compensate a variation in viscosity of the latter is estimated, a plurality of elementary quantities of solvent, or diluted ink, separated by ink, is sent to the print head, each of a volume comprised between 0.1 $cm^3$ and 5 $cm^3$, a sum of the elementary quantities of solvent or diluted ink being substantially equal to the correction volume to add.

2. Method according to claim 1, the correction volume of solvent, or diluted ink, being a function of a measured pressure value or a measured pressure variation.

3. Method according to claim 1, one or more of said elementary quantities of solvent or diluted ink, and/or their number and/or their frequency, taking account of the dilution, or of a dilution coefficient ($C_d$), of the ink by solvent or diluted ink.

4. Method according to claim 1, two successive sendings of solvent or diluted ink being separated by a duration enabling mixing, in the circuit, of solvent, or diluted ink, and ink sent.

5. Method according to claim 4, said duration being comprised between 0.1 and 1 minute.

6. Method according to claim 1, in which each elementary quantity has a volume comprised between 0.1 $cm^3$ and 1 $cm^3$.

7. Method according to claim 1, in which each elementary quantity is sent from the solvent or diluted ink reservoir, provided with an outlet valve, open for a duration comprised between 0.1 seconds and 5 seconds.

8. Method according to claim 1, in which each elementary quantity is pumped from the solvent or diluted ink reservoir, using a pump that also pumps ink from the ink reservoir or each elementary quantity is sent simultaneously with ink.

9. Method according to claim 1, the elementary quantities having decreasing volumes or elementary quantities of diluted ink are sent in the head and mixing between this diluted ink and ink taking place in the head, but not in the supply circuit upstream of the head.

10. Printing device using an ink jet printer, comprising:

at least one first ink reservoir and one second solvent or diluted ink reservoir, a print head, a return circuit for collecting in said first ink reservoir a flow of recovered ink coming from a gutter of the print head, a calculator for estimating a correction volume of solvent, or diluted ink, to add to the ink to compensate a variation in viscosity of the latter, a supply circuit for sending ink to the print head, and a plurality of elementary quantities of solvent, or diluted ink, separated by ink, to the print head, each of a volume comprised between 0.1 $cm^3$ and 5 $cm^3$, a sum of the elementary quantities of solvent, or diluted ink, being substantially equal to the correction volume of solvent, or diluted ink, to add.

11. Device according to claim 10, comprising a pressure sensor for measuring a pressure variation of ink and/or solvent sent to the print head and a controller for converting this pressure variation into correction volume of solvent to add.

12. Device according to claim 10, one or more of said elementary quantities of solvent or diluted ink and/or their number and/or their frequency taking account of, or being calculated as a function of, the dilution, or of a dilution coefficient ($C_d$), of the ink by solvent or diluted ink.

13. Device according to claim 10, said calculator calculating a duration, between two successive sendings of solvent, or diluted ink, enabling mixing, in the circuit, of solvent, or diluted ink, and ink sent.

14. Device according to claim 10, comprising a common pump to pump ink from the ink reservoir and/or solvent or diluted ink from the solvent or diluted ink reservoir, for sending to the print head.

15. Device according to claim 14, comprising a selector, for selectively connecting an outlet of the ink reservoir and/or an outlet of the solvent or diluted ink reservoir to said common pump.

16. Device according to claim 14, further comprising a damper for damping pressure fluctuations or undulations of ink and/or solvent or diluted ink from the common pump.

17. Device according to claim 16, the damper comprising a non-return valve, for preventing circulation of ink and/or solvent or diluted ink to the common pump.

18. Device according to claim 10, further comprising a third reservoir, connected to the supply circuit.

19. Device according to claim 10, comprising a circuit for sending directly in the print head a plurality of elementary quantities of diluted ink, mixing between ink and diluted ink taking place in the head, but not in the supply circuit upstream of the head.

20. Printing device using an ink jet printer, comprising:

at least one ink reservoir and a solvent or diluted ink reservoir, print head, a supply circuit for sending ink and/or solvent or diluted ink to the print head, a return circuit for collecting in the at least one ink reservoir a flow of recovered ink coming from a gutter of the print head, a calculator for estimating a correction volume of solvent, or diluted ink, to add to the ink to compensate a variation in viscosity of the latter, and means for sending a plurality of elementary quantities of solvent, or diluted ink, separated by ink, to the print head, each of a volume comprised between 0.1 $cm^3$ and 5 $cm^3$, a sum of the elementary quantities of solvent, or diluted ink, being substantially equal to the correction volume of solvent, or diluted ink, to add.

* * * * *